US006683596B2

(12) United States Patent
Ozawa

(10) Patent No.: US 6,683,596 B2
(45) Date of Patent: Jan. 27, 2004

(54) DATA LINE DRIVING CIRCUIT OF ELECTRO-OPTICAL PANEL, CONTROL METHOD THEREOF, ELECTRO-OPTICAL DEVICE, AND ELECTRONIC APPARATUS

(75) Inventor: Tokuro Ozawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 244 days.

(21) Appl. No.: 09/840,915

(22) Filed: Apr. 25, 2001

(65) Prior Publication Data

US 2002/0000969 A1 Jan. 3, 2002

(30) Foreign Application Priority Data

Apr. 26, 2000 (JP) ..... 2000-126030

(51) Int. Cl.[7] ..... G09G 3/36

(52) U.S. Cl. ..... 345/100; 345/92; 345/98; 345/205; 345/206

(58) Field of Search ..... 345/100, 103, 345/50, 55, 84, 87, 90, 92, 98–99

(56) References Cited

U.S. PATENT DOCUMENTS 5,900,857 A * 5/1999 Kuwata et al. ..... 345/100
6,054,974 A * 4/2000 Sakai et al. ..... 345/98
6,229,513 B1 * 5/2001 Nakano et al. ..... 345/99
6,243,066 B1 * 6/2001 Murakami et al. ..... 345/98
6,348,915 B1 * 2/2002 Yamashita et al. ..... 345/204
6,407,730 B1 * 6/2002 Hori ..... 345/100
6,429,844 B1 * 8/2002 Yoon ..... 345/98

FOREIGN PATENT DOCUMENTS

JP A 10-69249 3/1998
JP A 10-74060 3/1998

* cited by examiner

*Primary Examiner*—Bipin Shalwala
*Assistant Examiner*—Shapiro Leonid
(74) *Attorney, Agent, or Firm*—Oliff & Berridge, PLC

(57) ABSTRACT

The disclosed invention reduces the power consumption of a liquid-crystal device. A shift register section includes DX selection circuits and shift registers, which are divided into blocks. An X clock signal is supplied to a block in which the image data values do not match between horizontal lines which are adjacent in a data time-series manner, and is not supplied to a block in which the image data values match. In addition, for the block in which the image data values match, the image data, which forms time-division data becomes non-active, and the previous data value is maintained. For this reason, it is possible to reduce electric power for driving an X clock signal supply line and an image data supply line.

15 Claims, 15 Drawing Sheets

[FIG. 1]
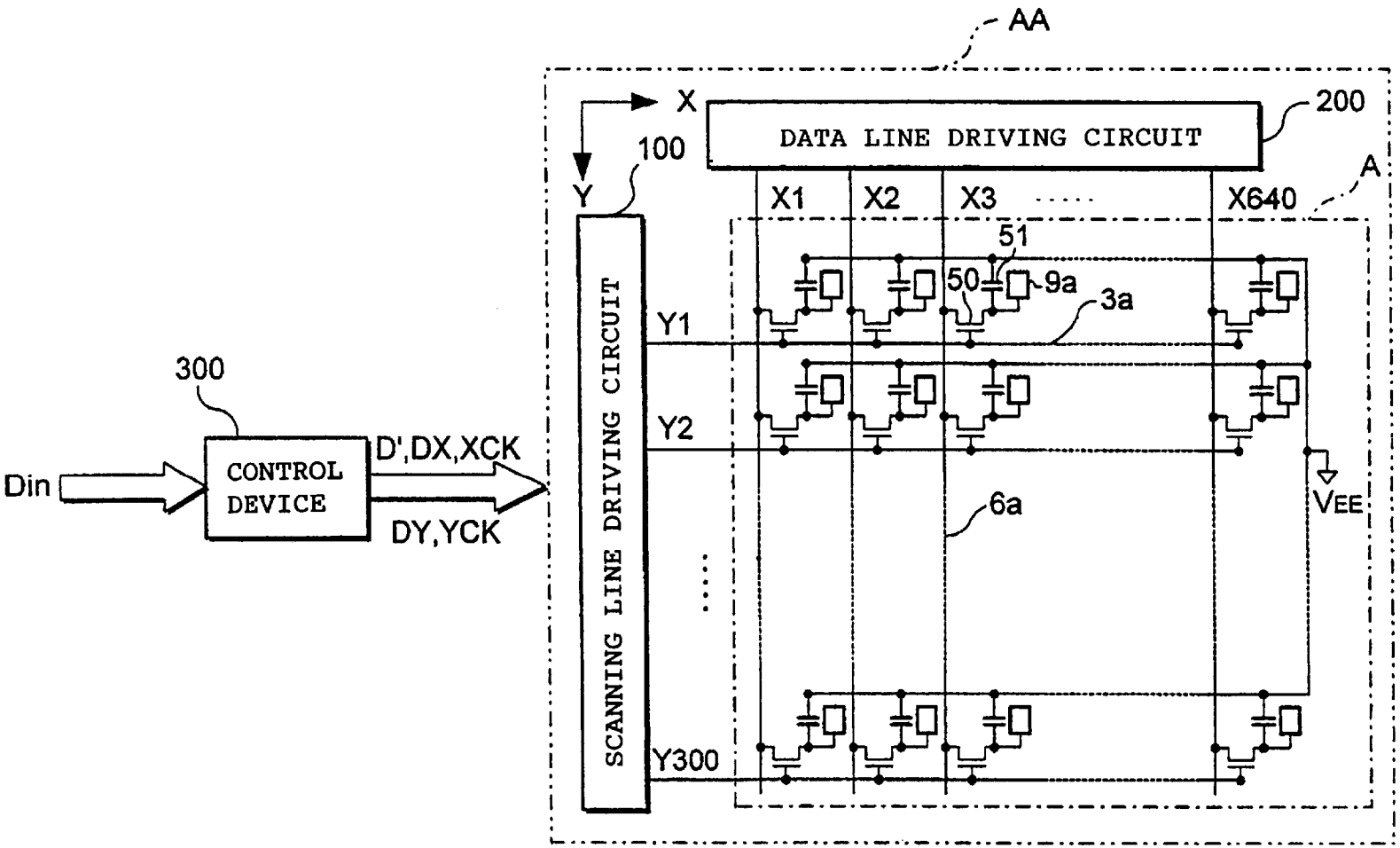

[FIG. 2]
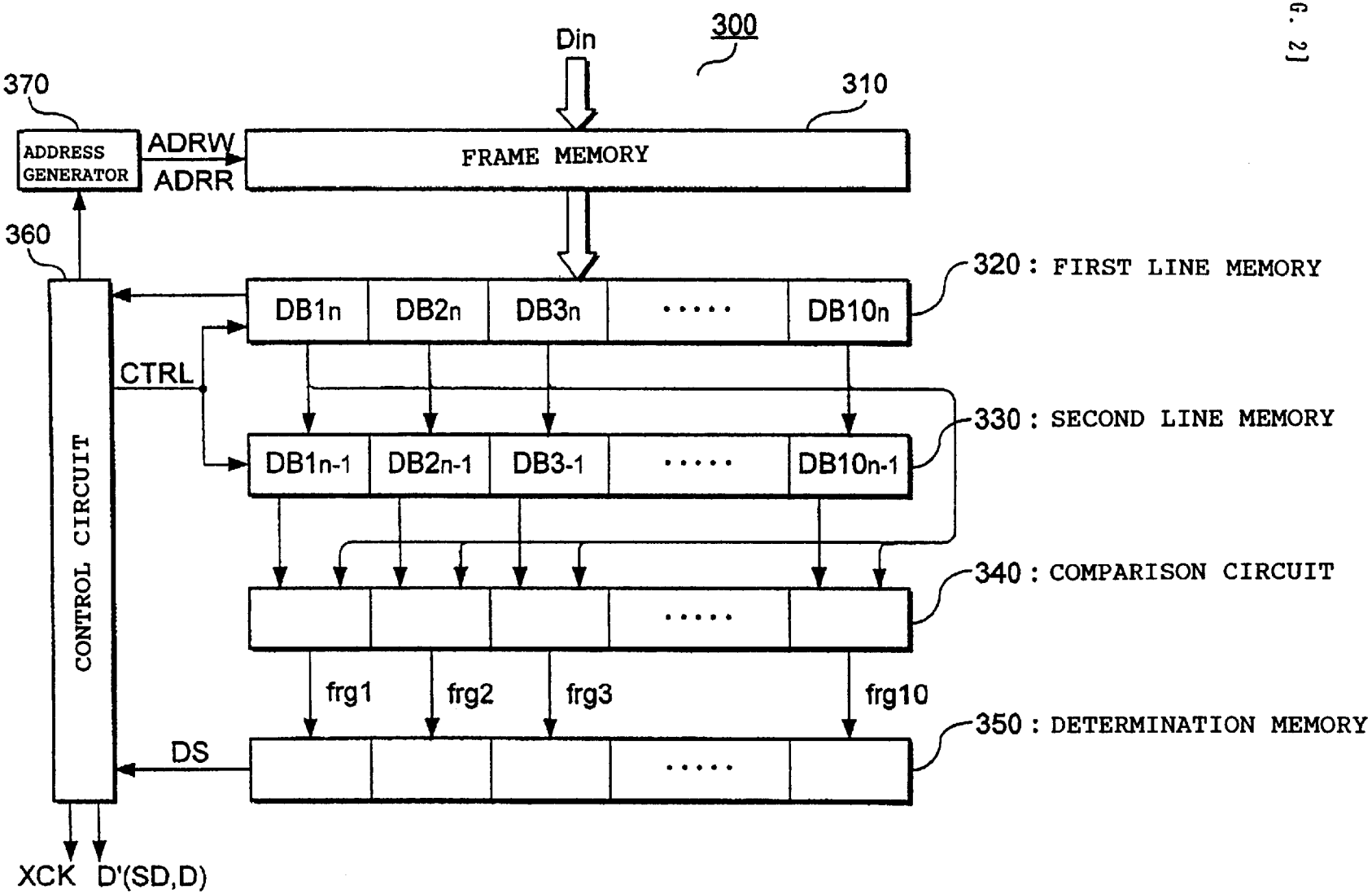

[FIG. 3]
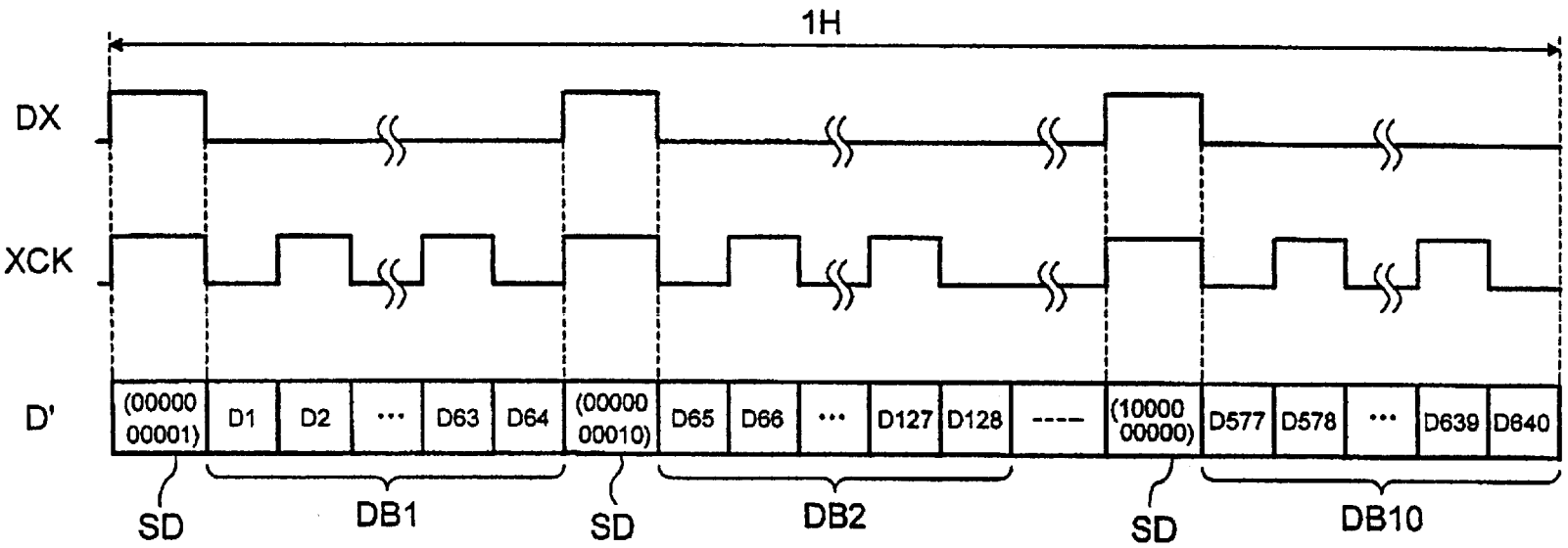

[FIG. 4]
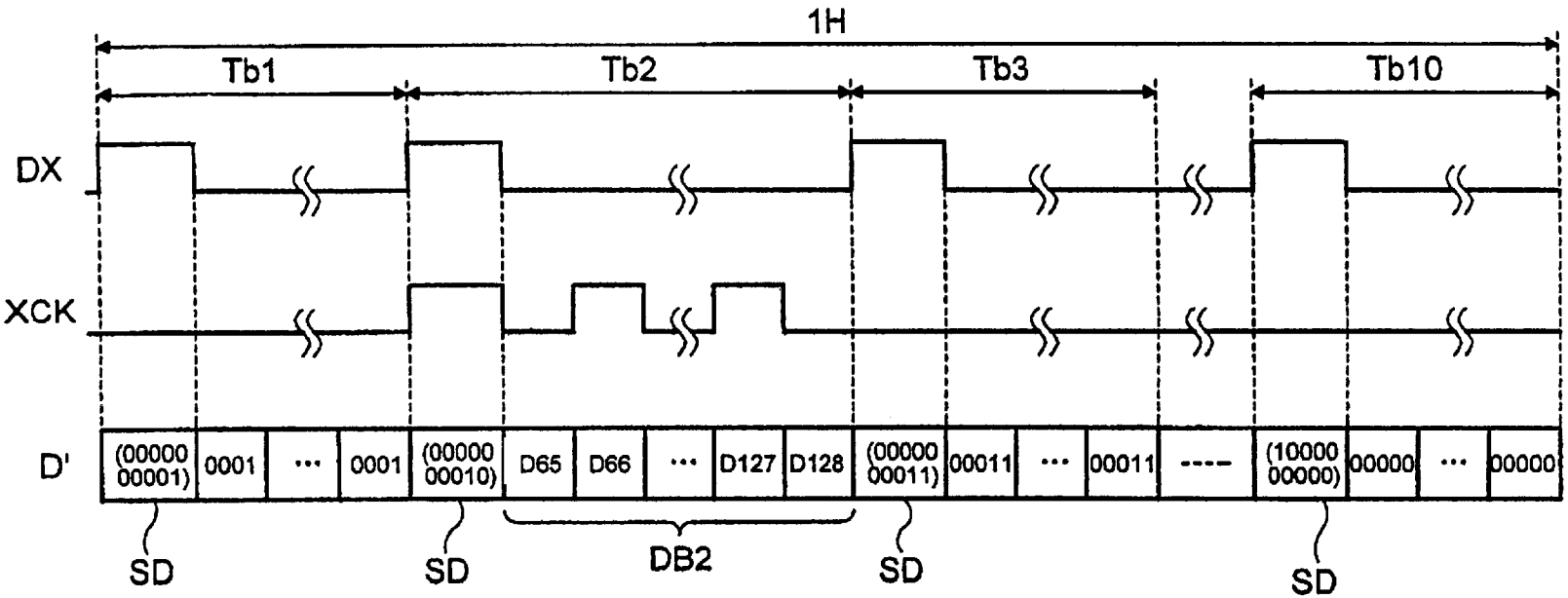

[FIG. 5]
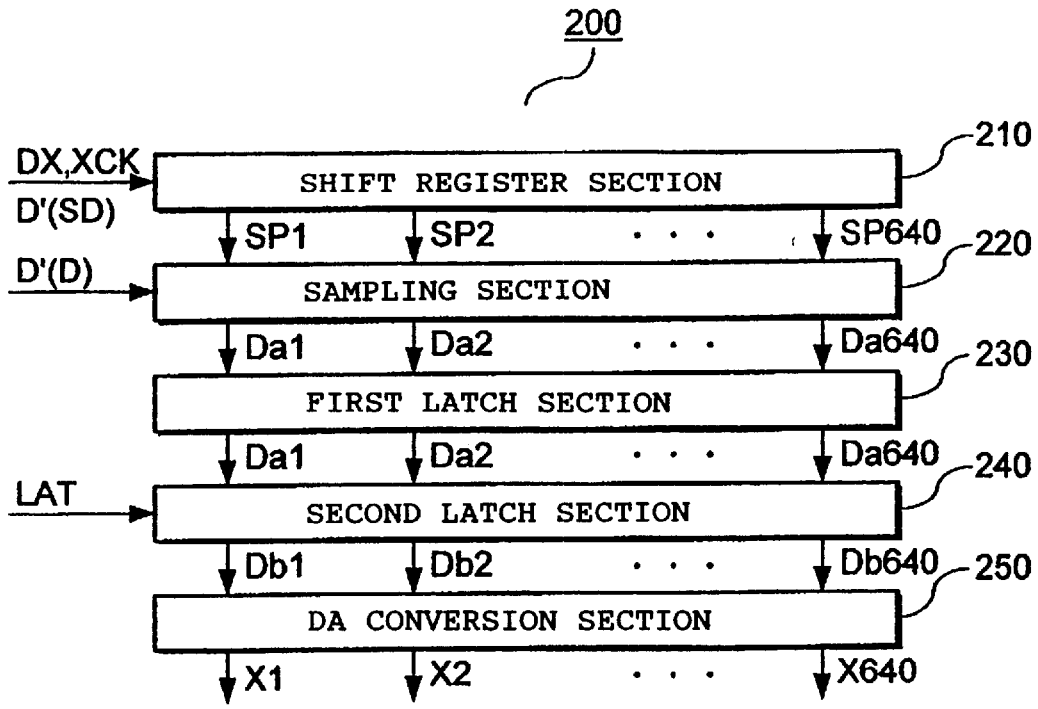

[FIG. 6]
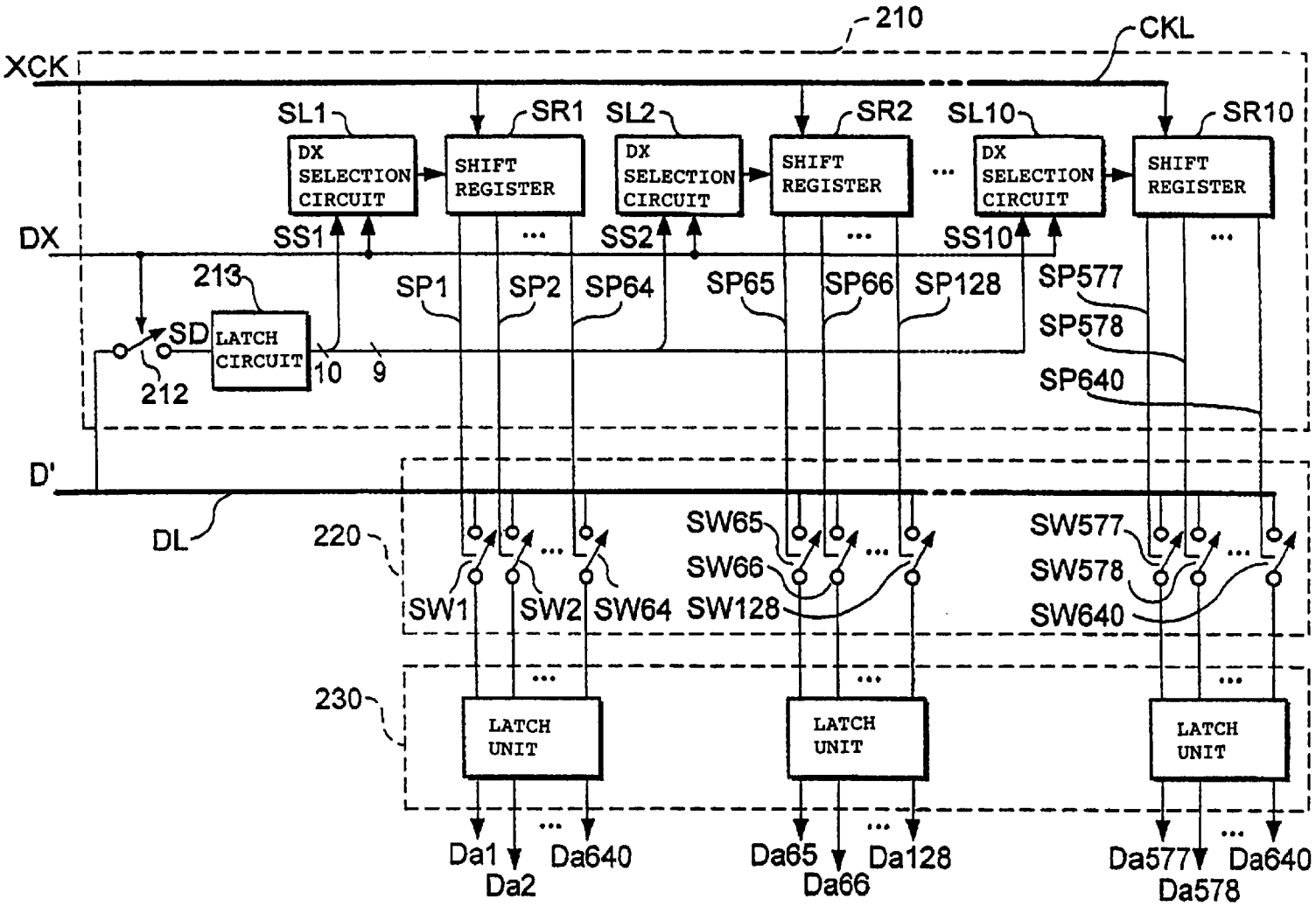

[FIG. 7]
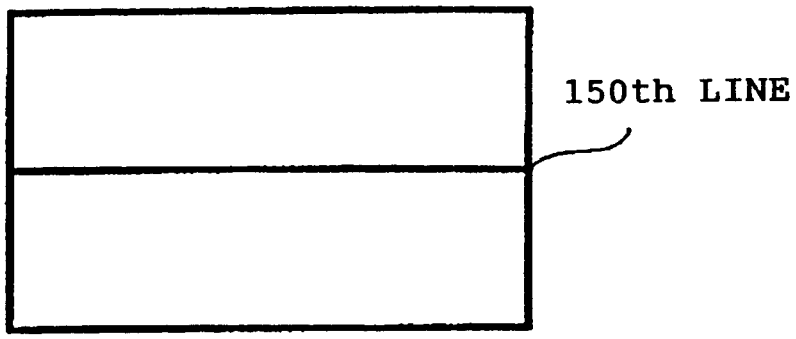

[FIG. 8]
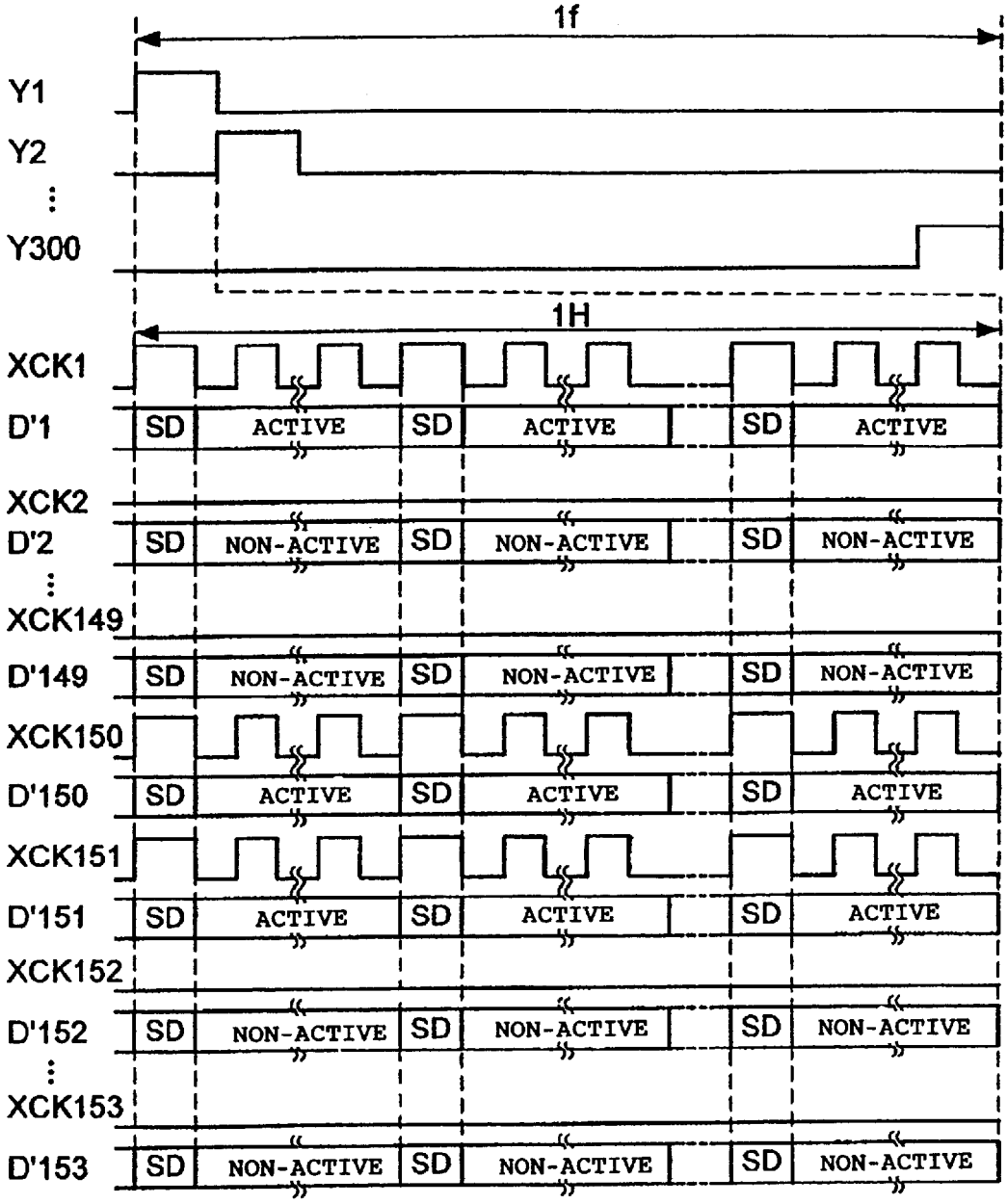

[FIG. 9]
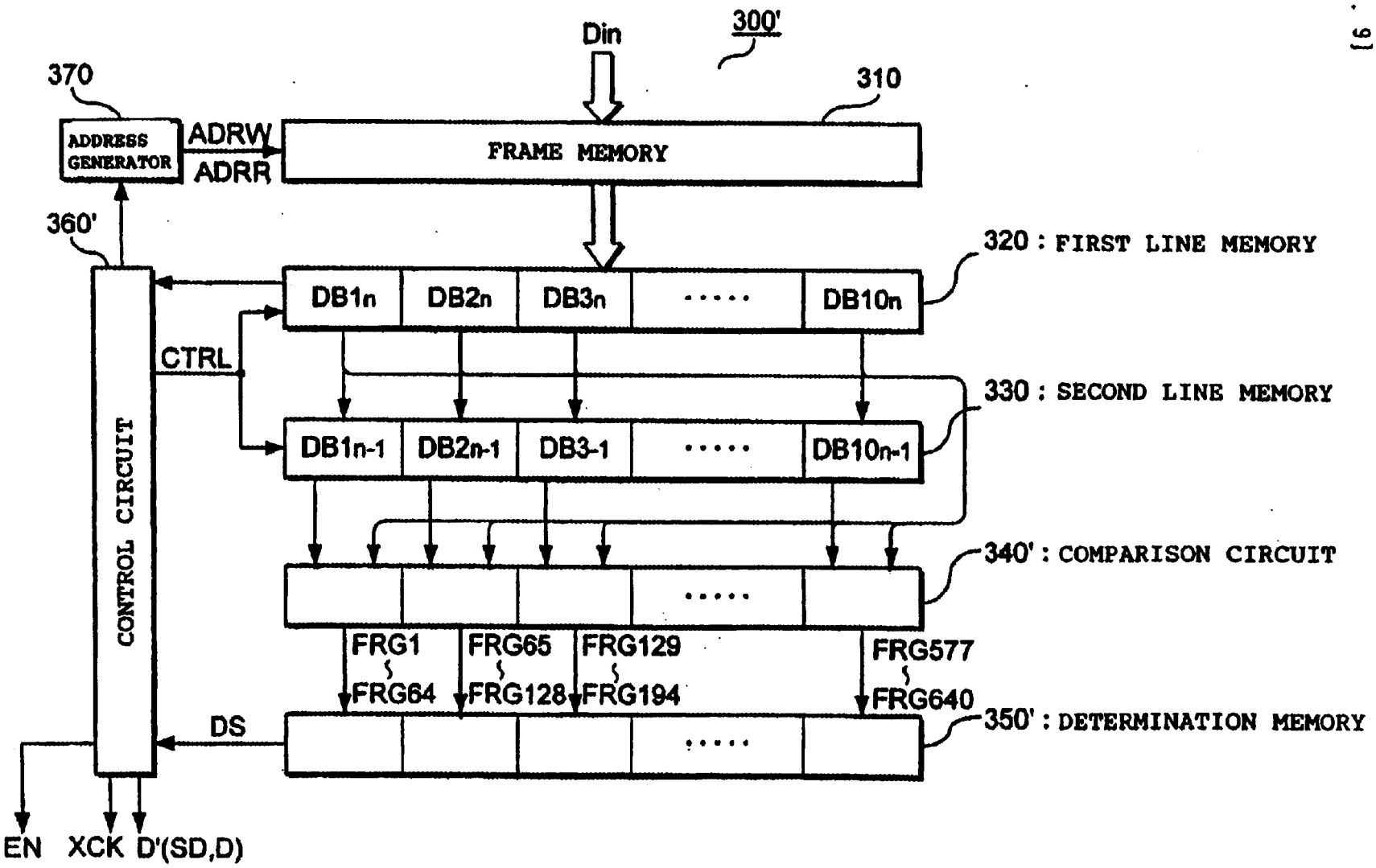

[FIG. 10]
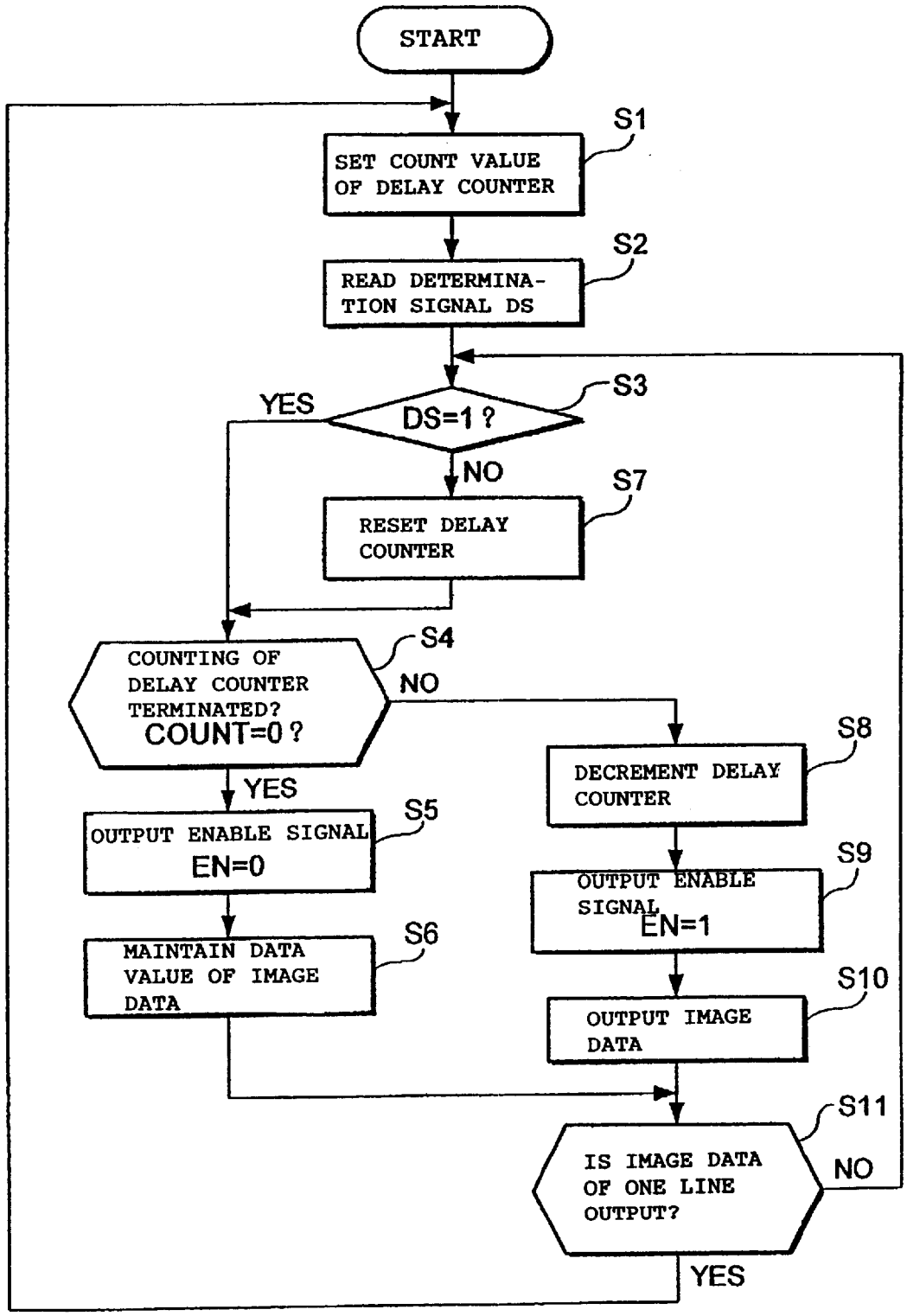

[FIG. 11]
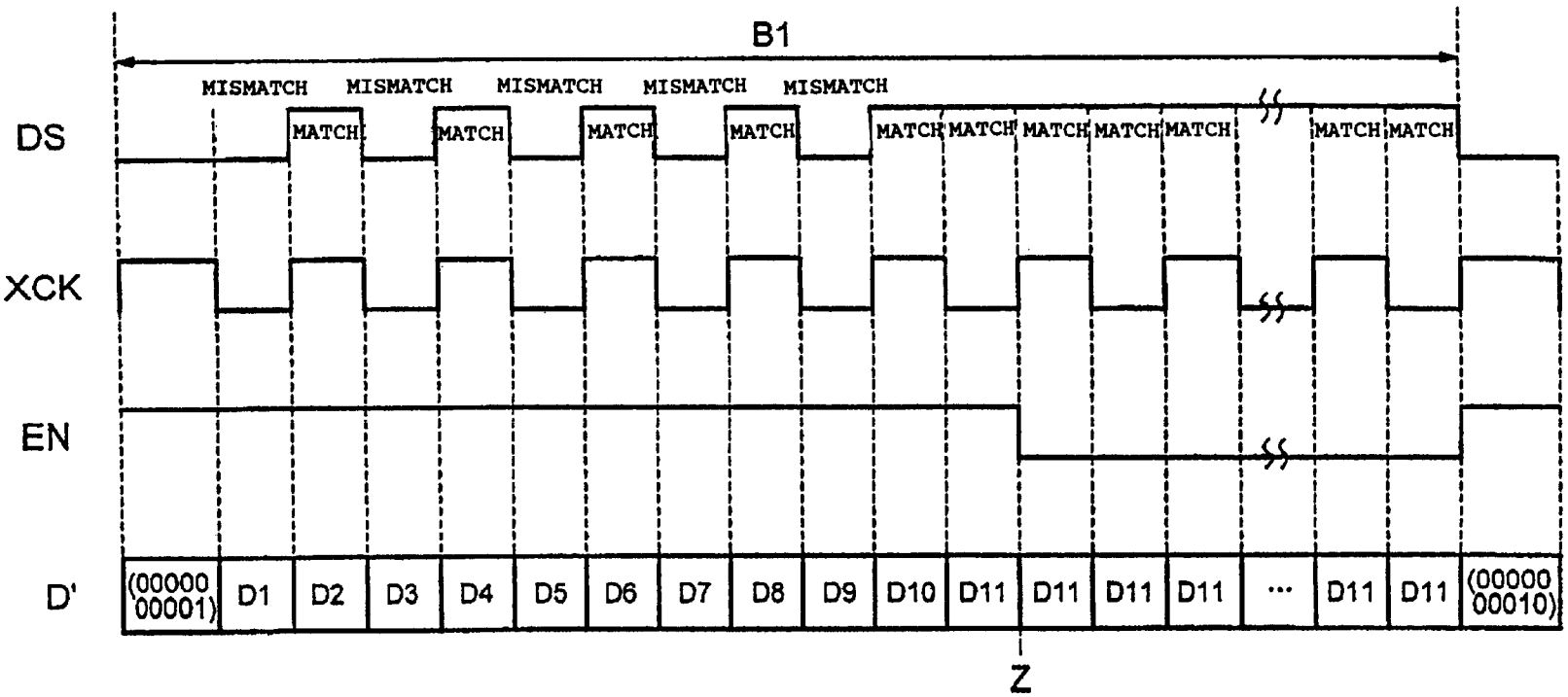

[FIG. 12]
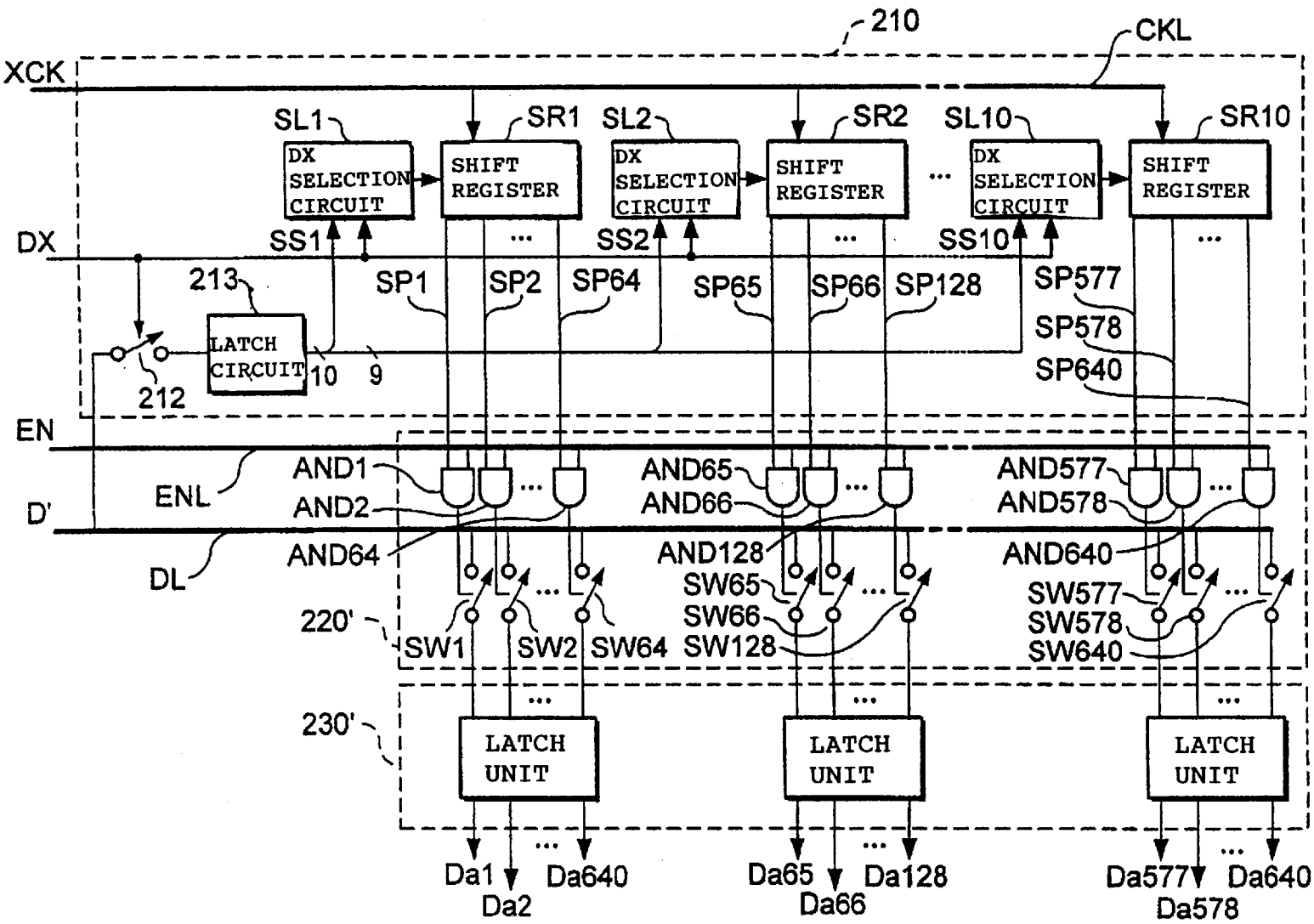

[FIG. 13]
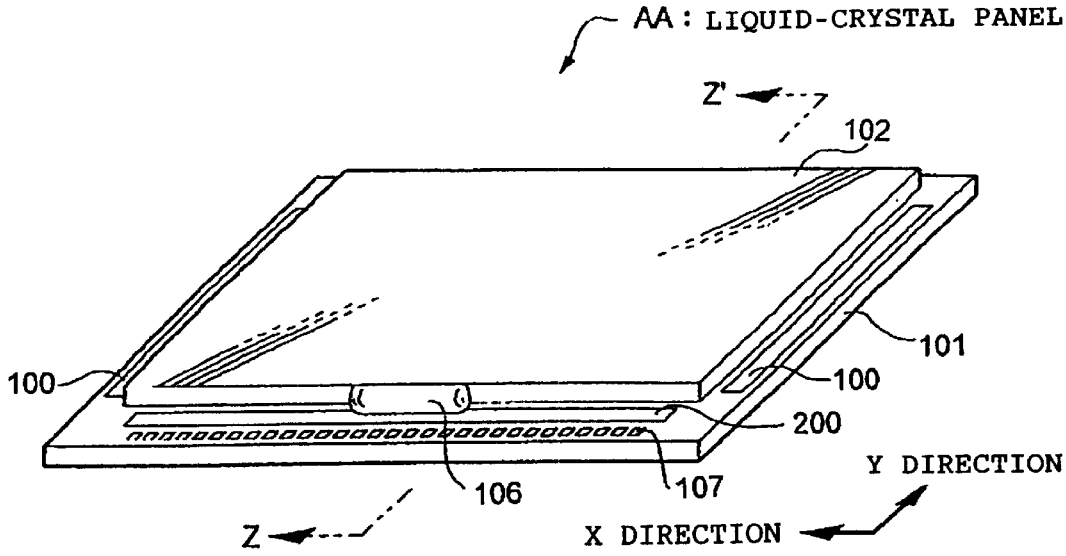
[FIG. 14]
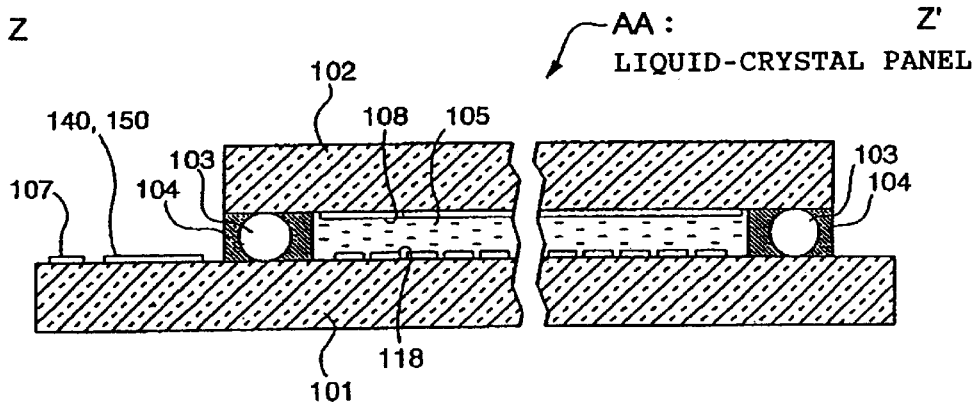

[FIG. 15]
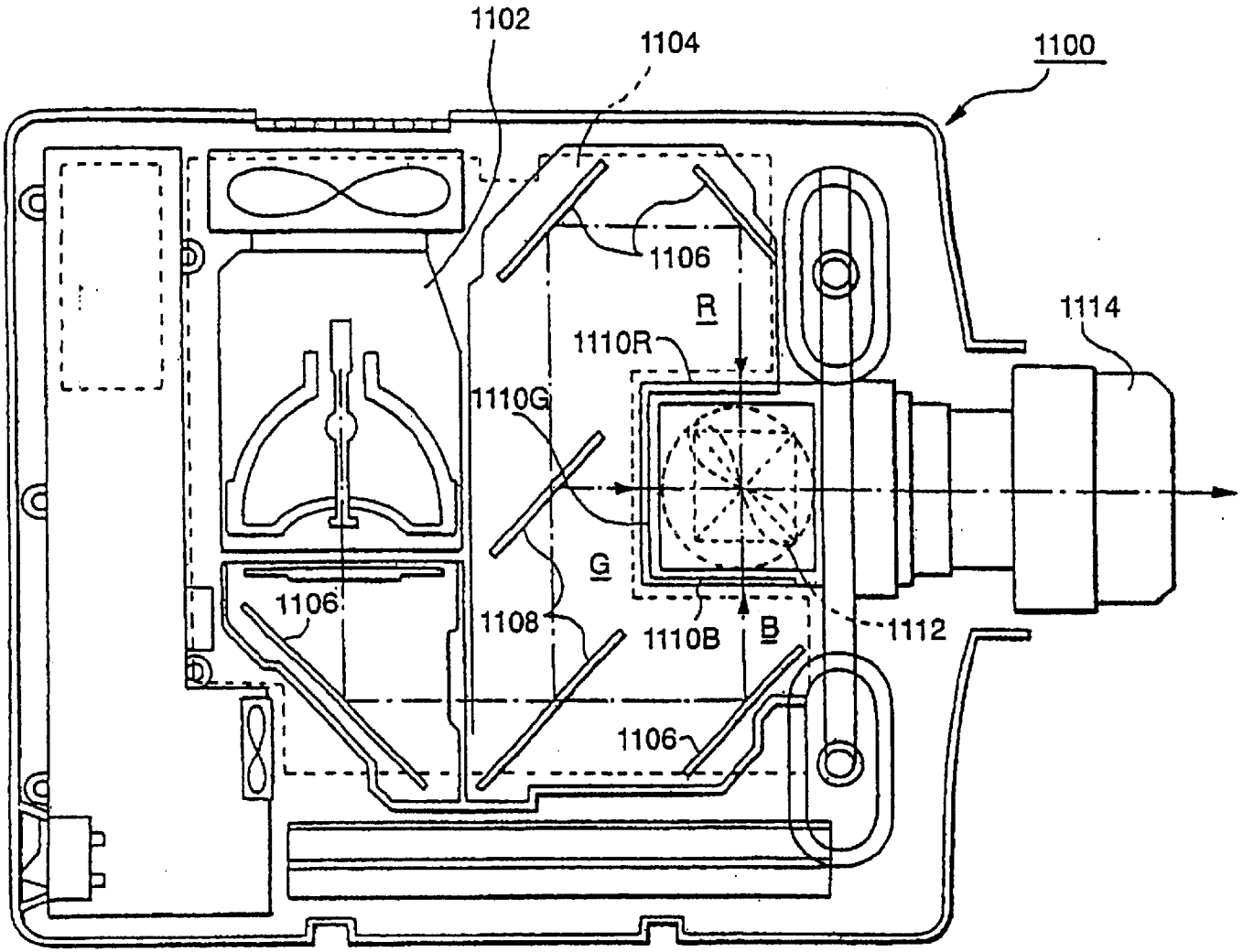

[FIG. 16]
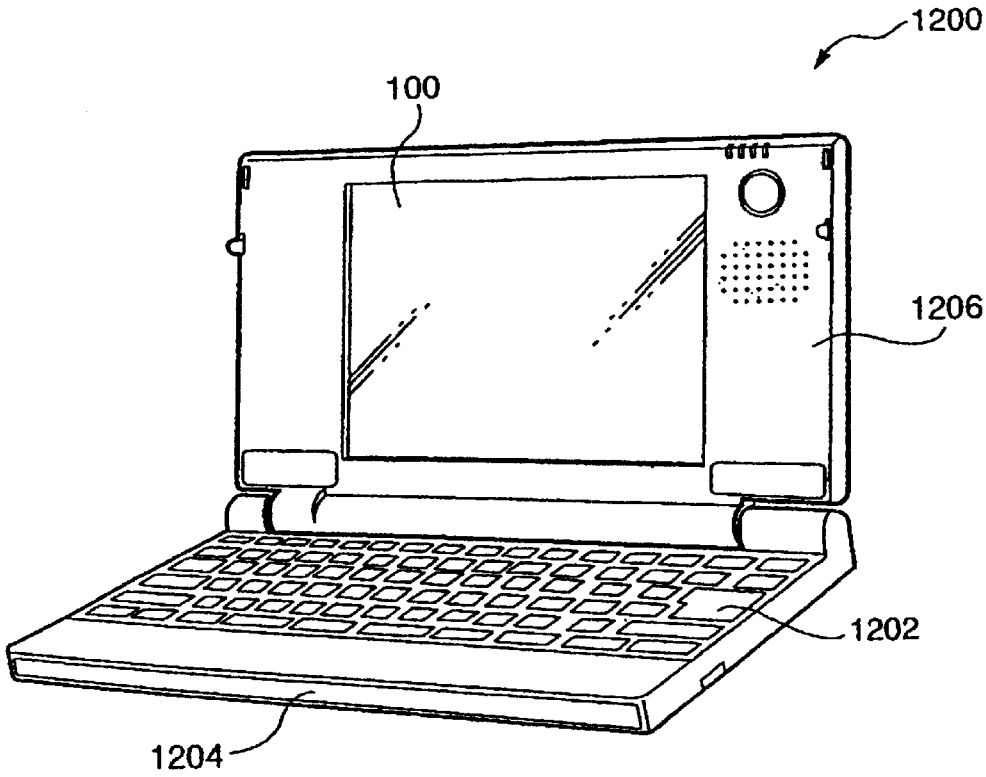
[FIG. 17]
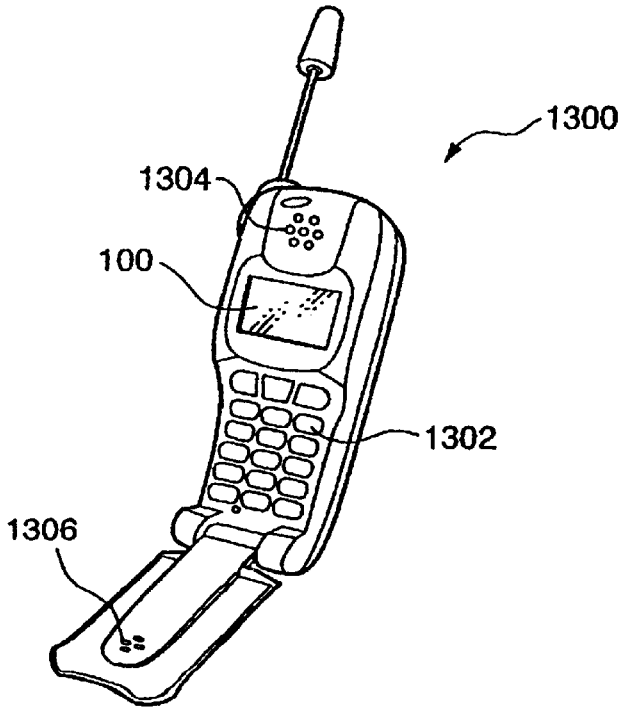

DATA LINE DRIVING CIRCUIT OF ELECTRO-OPTICAL PANEL, CONTROL METHOD THEREOF, ELECTRO-OPTICAL DEVICE, AND ELECTRONIC APPARATUS

BACKGROUND OF THE INVENTION

1. Field of Invention

The present invention relates to a data line driving circuit of an electro-optical panel, a control method thereof, an electro-optical device using these, and an electronic apparatus.

2. Description of Related Art

A conventional electro-optical device, for example, an active-matrix-type liquid-crystal display device, mainly includes a device substrate, on which a switching device is provided via pixel electrodes arrayed in a matrix, an opposing substrate, on which color filters, etc., are provided, and a liquid crystal which is provided between these two substrates. In such a structure, when a scanning line signal is applied to the switching device via scanning lines, the switching device is placed in a conducting state. During this conducting state, when an image signal is applied to the pixel electrode via data lines, a predetermined charge is stored in the liquid-crystal layer between the pixel electrode and the opposing electrode (common electrode). After the charge is stored, even if the switching device is turned off, the storage of the charge is maintained by the capacitance of the liquid-crystal layer if the resistance of the liquid-crystal layer is sufficiently high. In this manner, when each switching device is driven to control the amount of charge to be stored, the orientation state of the liquid crystal changes for each pixel, making it possible to display predetermined information.

In this case, since it may only be for a part of a period that the charge is stored in the liquid-crystal layer of each pixel, first, by having a scanning line driving circuit sequentially select each scanning line, and second, by supplying an image signal, obtained by converting image data into a line sequence and by a data line driving circuit performing DA conversion thereon to each data line time-division multiplex driving may be performed in which scanning lines and data lines are made common for a plurality of pixels becomes possible.

Here, the data line driving circuit includes a clock signal supply line, a shift register, an image data supply line, a sampling circuit, a first latch, a second latch, and a DA conversion circuit. The shift register sequentially shifts a transfer start pulse of a horizontal scanning period in accordance with a clock signal supplied via the clock signal supply line in order to generate each sampling signal corresponding to each data line. The sampling circuit samples image data supplied via the image data supply line in accordance with each sampling signal and supplies it to the first latch. The first latch maintains the sampled image data and creates point sequence image data. The second latch latches the point sequence image data in order to create the line sequence image data in accordance with a latch pulse of a horizontal scanning period and supplies this data to each data line.

In the above-described liquid-crystal display device, even if the switching device is turned off, the storage of the charge is maintained by the capacitance of the liquid-crystal layer. Concerning a particular pixel, if the gray scale value to be displayed in the pixel concerned is the same as that one field before, there is no need to supply an image signal to the pixel in the current field in order to newly re-store charge in the liquid-crystal layer. For this reason, by supplying an image signal to only a pixel in which there is a change between fields in order to rewrite the stored charge, reduction of the processing speed is possible, leading to reduced power consumption.

In such a liquid-crystal display device, it is necessary to specify a pixel in which there is a change between fields and to supply an image signal to a corresponding data line in a period in which the pixel concerned is selected by a scanning line signal. In this case, it is necessary to, by using an address decoder, specify the image data concerned by using a row address and a column address and to generate a scanning line signal and a data line signal from these addresses.

However, a problem arises that the circuit scale of the address decoder becomes large, and as a consequence, the power consumption is increased. In particular, a problem arises that even if an attempt to form an address decoder on a device substrate is made by using thin-film transistors (hereinafter referred to as "TFTs"), the circuit scale thereof is too large to be realized.

SUMMARY OF THE INVENTION

The present invention has been achieved in view of the above-described circumstances. An object of the present invention is to provide a data line driving method and apparatus suitable for reducing power consumption with a simple structure, an electro-optical device using the data line driving device, and an electronic apparatus in which this electro-optical device is used as a display.

To achieve the above-mentioned object, the data line driving circuit of the present invention is used for an electro-optical panel, which has a plurality of scanning lines, a plurality of data lines, and switching devices, and pixel electrodes arranged in such a manner as to correspond to the intersection of the scanning lines and the data lines and which is divided into blocks in units of a predetermined number of data lines. The data line driving circuit includes: a shift register section having a clock signal supply line that supplies a clock signal, a plurality of shift registers that sequentially shift a transfer start pulse in accordance with the clock signal in order to generate each sampling signal, the plurality of shift registers being provided in such a manner as to correspond to each of the blocks, and a selection circuit that selectively supply the transfer start pulse to each of the shift registers; an image data conversion section that samples image data in accordance with each of the sampling signals and converts the data obtained by performing sampling into line sequence image data after the data is latched; and a DA conversion section that outputs each data line signal obtained by performing DA conversion on the line sequence image data to each of the data lines.

According to the present invention, since the shift register section is divided into blocks by a plurality of shift registers, it is possible to selectively cause a necessary shift register to operate. Consequently, it is possible to reduce power consumption.

In the present invention, the sampling section may perform sampling in accordance with each of the sampling signals only when an enable signal supplied from the outside becomes active. In this case, since sampling is performed in accordance with an enable signal, for example, even if shift registers operate to generate sampling signals for a particular block, it is possible to sample image data only for a necessary dot from these signals.

Furthermore, in a case where the above-described data line driving circuit is controlled, preferably, image data is compared between horizontal lines which are adjacent in a data time-series manner, and supply of the clock signal is stopped for the block in which the data values match. Since the sampled image data is latched by the image data conversion section, when the image data values match between horizontal lines which are adjacent in a data time-series manner, it is not necessary to sample the image data again and to latch it. On the other hand, in order to perform sampling, it is necessary to cause the shift register to operate in order to generate a sampling signal by supplying a clock signal thereto, and parasitic capacitance occurs in the wiring which supplies the clock signal. Since the wiring acts as a capacitive load, in order to supply the clock signal at a sufficient through rate, a large amount of electric power is required. According to the present invention, since supply of the clock signal is stopped for the block in which the data values match, the power consumption can be greatly reduced.

In addition, in a case where the above-described data line driving circuit is controlled, preferably, image data is compared between horizontal lines which are adjacent in a data time-series manner, and supply of the image data is stopped for the block in which the data values match. Since the sampled image data is latched by the image data conversion section, when the image data values match between the horizontal lines which are adjacent in a data time-series manner, it is not necessary to sample the image data again and to latch it. On the other hand, parasitic capacitance occurs in the wiring which supplies the image data. Since the wiring acts as a capacitive load, in order to supply the image data at a sufficient through rate, a large amount of electric power is required. According to the present invention, since supply of the image data is stopped for the block in which the data values match, the power consumption can be greatly reduced.

Next, the electro-optical device according to the present invention includes: an electro-optical panel which has a plurality of scanning lines, a plurality of data lines, and switching devices and pixel electrodes arranged in such a manner as to correspond to the intersection of the scanning lines and the data lines, and which is divided into blocks in units of a predetermined number of data lines; a data line driving circuit that generates each data line signal to be supplied to each of the data lines; a scanning line driving circuit that generates each scanning line signal to be supplied to each of the scanning lines; and a control circuit that controls the data line driving circuit on the basis of image data. The control circuit includes: a determination section that compares the image data between horizontal lines which are adjacent in a data time-series manner in order to determine whether or not the data values match between the horizontal lines for each of the blocks and generates a determination signal which indicates the determination result for each of the blocks; and a clock signal generation section that generates, in accordance with the determination signal, a clock signal which becomes active only for the block in which there is a change in the data values between the horizontal lines. The data line driving circuit includes: a shift register section having a plurality of shift registers which sequentially shift the transfer start pulse of a block period in accordance with the clock signal in order to generate each sampling signal, the plurality of shift registers being provided in such a manner as to correspond to each of the blocks, a clock signal supply line that supplies the clock signal to each of the shift registers, and a selection circuit that supplies the transfer start pulse to each of the shift registers in accordance with a selection signal indicating to which block the image data corresponds; an image data conversion section that samples image data in accordance with each of the sampling signals and converts the data obtained by performing sampling into line sequence image data; and a DA conversion section that outputs each data line signal obtained by performing DA conversion on the line sequence image data to each of the data lines.

According to the present invention, it is determined whether or not the image data values match between horizontal lines which are adjacent in a data time-series manner, and based on the determination result, the clock signal is set to be active only for the block in which there is a change in the data values between the horizontal lines. Consequently, it is possible to reduce the electric power required to drive the clock signal supply line, making it possible to reduce the power consumption of the electro-optical device.

Furthermore, in the present invention, preferably, the determination section includes: a first line memory that stores image data; a second line memory that stores the image data which is previous by one horizontal scanning period; a comparison circuit that compares first image data read from the first line memory with second image data read from the second line memory in order to determine whether or not the data values match between horizontal lines for each of the blocks; and a determination memory that stores the determination result of the comparison circuit for each block, wherein the determination signal is generated by sequentially reading the determination result from the determination memory. In this case, it is possible to generate a determination signal with a simple structure.

Also, in the invention of the above-described electro-optical device, preferably, the control circuit includes an image data creation section that creates image data which becomes active only for the block in which there is a change in the data value between horizontal lines in accordance with the determination signal and that supplies the image data which is created via an image data supply line to the sampling section. In this case, since the image data is transmitted through the image data supply line only for the block in which there is a change in the data values, it is possible to reduce the electric power required to drive the image data supply line.

Also, in the invention of the above-described electro-optical device, preferably, the image data creation section creates a time-division signal in which the selection signal is interposed before the image data divided for each block and supplies this signal to the sampling section via the image data supply line. The shift register section includes a separation circuit that separates the selection signal from the time-division signal, and the sampling section samples the portion of the image data within the time-division signal. In this case, since the selection signal and the image data can be transmitted by one wire by using the time-division signal, it is possible to simplify the structure.

In addition, preferably, the time-division signal creation section causes the last logic level of the selection signal to continue for the block in which the image data becomes non-active. Since the time during which electric power is consumed in the logic circuit is the time when the logic level is changed, it is possible to reduce the power consumption by causing the logic level of the selection signal to continue.

Next, the electro-optical device according to the present invention includes an electro-optical panel having a plurality of scanning lines, a plurality of data lines, and switching devices and pixel electrodes arranged in such a manner as to correspond to the intersection of the scanning lines and the data lines; a data line driving circuit that generates each data line signal to be supplied to each of the data lines; a scanning line driving circuit that generates each scanning line signal to be supplied to each of the scanning lines; and a control circuit that controls the data line driving circuit in accordance with image data. The control circuit includes: a determination section that compares the image data between horizontal lines which are adjacent in a data time-series manner in order to determine whether or not the data values match between the horizontal lines for each dot; an enable signal generation section that generates, based on the determination result of the determination section, an enable signal which becomes non-active for a predetermined dot in which the data values match between the horizontal lines; and an image data creation section that outputs the image data to an image data supply line when the enable signal becomes active. The data line driving circuit includes: sampling sections each for sampling the image data in accordance with each sampling signal only when the enable signal becomes active; an image data conversion section that converts the data obtained by performing sampling by the sampling section into line sequence image data; and a DA conversion section that outputs each data line signal obtained by performing DA conversion on the line sequence image data to each of the data lines.

According to the present invention, since it is determined whether or not the data values change between horizontal lines which are adjacent in a data time-series manner in dot units and the image data is supplied to the image data supply line, it is possible to reduce the electric power required to drive the image data supply line even more.

Also, in the above-described invention, preferably, the determination section includes: a first line memory that stores image data; a second line memory that stores image data which is previous by one horizontal scanning period; a comparison circuit that compares first image data read from the first line memory with second image data read from the second line memory for each dot; and a determination memory that stores the determination result of the comparison circuit for each block.

Also, in the above-described invention, preferably, the enable signal generation section causes, based on the determination result of the determination section, the enable signal to become non-active when a predetermined number of dots in which the data values match between horizontal lines continue. According to the present invention, unless a certain amount of mismatching of the data values continues, the logic level of the enable signal does not change, and consequently, the power consumption required to drive the enable signal can be reduced. In a case where a match and a mismatch of the data values repeat in dot units, since matches have not occurred continuously, the enable signal does not become non-active, and no electric power is consumed to drive the enable signal, whereas when the number of dots in which a match occurs exceeds a predetermined number, the enable signal becomes non-active, making it possible to reduce the electric power required to drive the image data.

Furthermore, preferably, the image data creation section sets the level of the image data supply line to be constant when the enable signal becomes non-active.

In addition, preferably, the electro-optical panel is divided into each of blocks in units of a predetermined number of data lines. The control circuit includes a clock signal generation section that generates, based on the determination result of the determination section, a clock signal which becomes active only for a block in which there is a change in the data values between horizontal lines. The data line driving circuit includes a shift register section having a plurality of shift registers which each sequentially shift a transfer start pulse of a block period in accordance with the clock signal in order to generate each sampling signal and which correspond to each of the blocks, respectively, a clock signal supply line that supplies the clock signal to each of the shift registers, and a selection circuit that supplies the transfer start pulse to each of the shift registers in accordance with a selection signal indicating to which block the transfer start pulse corresponds.

Next, an electronic apparatus of the present invention uses the electro-optical device as a display section, and, for example, an applicable device is a view-finder used for a video camera, a portable phone, a notebook computer, and a video projector.

BRIEF DESCRIPTION OF THE DRAWINGS

FIG. 1 is a block diagram showing the overall structure of a liquid-crystal device according to a first embodiment of the present invention.

FIG. 2 is a block diagram of a control device used in the first embodiment.

FIG. 3 is a timing chart of various signals of a control circuit in a case where there is a change in all the blocks between adjacent horizontal lines.

FIG. 4 is a timing chart of various signals of the control circuit in a case where there is a change only in the second block in the image data between adjacent horizontal lines.

FIG. 5 is a block diagram showing the structure of the main portion of a data line driving circuit used in the first embodiment.

FIG. 6 is a block diagram showing the structure of a shift register section and peripheral circuits thereof used in the first embodiment.

FIG. 7 is a diagram showing an example of a display screen.

FIG. 8 is a timing chart illustrating the operation of the liquid-crystal device according to the first embodiment.

FIG. 9 is a block diagram of a control device for use in a second embodiment.

FIG. 10 is a flowchart showing the operation of the control circuit for the generation of an enable signal and image data.

FIG. 11 is a timing chart of a determination signal, an X clock signal, an enable signal, and time-division data.

FIG. 12 is a block diagram of a sampling section and peripheral circuits thereof for use in the second embodiment.

FIG. 13 is a perspective view showing the structure of a liquid-crystal panel.

FIG. 14 is a sectional view along plane Z–Z' in FIG. 13.

FIG. 15 is a sectional view showing the structure of a projector, which is an example of an electronic apparatus, to which the liquid-crystal device is applied.

FIG. 16 is a perspective view showing the structure of a personal computer, which is an example of an electronic apparatus, to which the liquid-crystal device is applied.

FIG. 17 is a perspective view showing the structure of a portable phone, which is an example of an electronic apparatus, to which the liquid-crystal device is applied.

DETAILED DESCRIPTION OF PREFERRED EMBODIMENTS

The embodiment of the present invention will be described below with reference to the drawings.

<1. First Embodiment>

<1-1. Overall Structure of Liquid-crystal Device>

First, an electro-optical device according to the present invention will be described by taking, as an example, a liquid-crystal device using a liquid crystal as an electro-optical material. The main portion of the liquid-crystal device is formed from a liquid-crystal panel AA, in which a device substrate, having formed thereon TFTs as switching devices, and an opposing substrate face each other in such a manner that the electrode formed sides face each other and at a fixed spacing, and a liquid crystal is disposed in this spacing.

FIG. 1 is a block diagram showing the overall structure of the liquid-crystal device according to this embodiment. This liquid-crystal device includes the liquid-crystal panel AA and an external processing circuit. On the device substrate of the liquid-crystal panel AA, an image display area A, a scanning line driving circuit 100, and a data line driving circuit 200 are formed. Also, the liquid-crystal device includes a control device 300 as an external processing circuit.

Input image data Din supplied to this liquid-crystal device is, for example, in a 5-bit parallel form. In this example, for the sake of simplicity of the following description, a description is provided assuming that the input image data Din corresponds to one color. However, the present invention is not intended to be limited thereto, and of course, the data may correspond to the three primary colors of RGB.

Here, the control device 300 generates, in synchronization with the input image data Din, a Y clock signal YCK, an X clock signal XCK, a Y transfer start pulse DY, an X transfer start pulse DX, a latch pulse LAT, etc., and supplies these signals to each of the scanning line driving circuit 100 and the data line driving circuit 200.

In addition, the control device 300, as will be described later, compares the input image data Din between horizontal lines which are adjacent in a data time-series manner, and for the block in which the data values match, stops the generation of the X clock signal XCK and stops the supply of the image data D.

<1-2. Image Display Area>

In the image display area A, m scanning lines 3*a* are formed in such a manner as to be arrayed in parallel in the X direction, and n data lines 6*a* are formed in such a manner as to be arrayed in parallel in the Y direction. A description is given below by taking, as an example, a case in which m=640 and n=300. Also, the image display area A is divided into 10 portions in the X direction, and an area corresponding to the data lines 6*a* at intervals of 64 lines is called "one block".

As shown in FIG. 1, near the intersection between the scanning lines 3*a* and the data lines 6*a*, the gate of a TFT 50 is connected to the scanning line 3*a*, the source of the TFT 50 is connected to the data line 6*a*, and the drain of the TFT 50 is connected to a pixel electrode 9*a*. Each pixel includes the pixel electrode 9*a*, an opposing electrode formed on the opposing substrate, and a liquid crystal disposed between the two electrodes. As a result, the pixels are arranged in a matrix in such a manner as to correspond to each intersection between the scanning lines 3*a* and the data lines 6*a*.

Also, the structure is formed in such a way that scanning line signals Y1, Y2, . . . , Y300 are applied in line sequence in a pulsed manner to each scanning line 3*a* to which the gate of the TFT 50 is connected. For this reason, when a scanning line signal is supplied to a particular scanning line 3*a*, the TFT 50 connected to the scanning line concerned is turned on, causing data line signals X1, X2, . . . , X640 which are supplied at a predetermined timing from the data lines 6*a* to be written to the corresponding pixels in sequence, after which the signals are maintained for a predetermined period.

Here, since the orientation and the order of the liquid crystal molecules change according to the level of the voltage applied to each pixel, a gray scale display by light modulation is made possible. For example, the amount of light which passes through the liquid crystal is limited as the applied voltage is increased in the case of a normally white mode, and in the case of a normally black mode, the amount of light is lessened as the applied voltage is increased. As a result, in the entire liquid-crystal device, light having a contrast corresponding to the image signal is emitted for each pixel. This makes a predetermined display possible. The image display area A of this example is formed so as to operate in the normally white mode.

Furthermore, in order to prevent the maintained image signal from leaking, a storage capacitance 51 is added in parallel with a liquid-crystal capacitance formed between the pixel electrode 9*a* and the opposing electrode. For example, since the voltage of the pixel electrode 9*a* is held in the storage capacitance 51 by a time which is as much as three orders of magnitude longer than the time in which the source voltage was applied, the holding characteristics are improved, resulting in a higher contrast ratio.

<1-3. Scanning Line Driving Circuit>

Next, the scanning line driving circuit 100 includes a Y shift register, a level shifter, etc. The period of the Y shift register is a vertical scanning period, and the Y shift register shifts a Y transfer start pulse DY which becomes active at the start of the vertical scanning period in the Y direction by using the Y clock YCK which is inverted every horizontal scanning period. The level shifter level-shifts the sequentially shifted signals in order to generate scanning line signals Y1, Y2, . . . , Y300. Each of the scanning line signals Y1, Y2, . . . , Y300 is supplied to the scanning lines 3*a* in line sequence in a pulsed manner.

<1-4. Control Device>

Next, the control device 300 is described. FIG. 2 is a block diagram showing the structure of the main part of the control device. As shown in this figure, the control device 300 includes a frame memory 310, a first line memory 320, a second line memory 330, a comparison circuit 340, a determination memory 350, a control circuit 360, and an address generator 370.

In the following description, concerning a particular horizontal line, the image data D corresponding to the data line signals X1, X2, . . . , X640 shown in FIG. 1 is described as D1, D2, . . . , D640, each of the first to tenth blocks is described as B1 to B10, the image data D corresponding to each block is described as DB1 to DB10, and furthermore, line numbers are shown by suffixes in order to clarify the line to which the image data D belongs, as necessary. For example, D20*n* means the twentieth image data of the n-th line, and DB1*n* means the image data of the first block of the n-th line.

First, the frame memory 310 includes two field memories. The frame memory 310 is used to read the stored input image data Din from one of the field memories in a field period in which the input image data Din is written in the other field memory, and in the next field period, the other field memory is used for writing. Furthermore, reading and writing of the input image data Din are performed based on a writing address ADRW and a reading address ADRR generated by the address generator 370.

Next, the first line memory 320 and the second line memory 330 are controlled by a control signal CTRL in such a way that reading and writing are performed in a horizontal scanning period. The first line memory 320 stores the input image data Din read from the frame memory 310. On the other hand, the second line memory 330 stores the image data DB1*n* output from the first line memory 320. For this reason, the image data D read from the second line memory 330 is delayed by one horizontal scanning period in comparison with the image data D read from the first line memory 320. In this example, it is assumed that the image data DB1*n* to DB10*n* of the n-th line is stored in the first line memory 320, and that the image data DB1*n*−1 to DB10*n*−1 of the (n−1)-th line is stored in the second line memory 330.

Next, the comparison circuit 340 includes 10 comparison units CU1 to CU10. Each of the comparison units CU1 to CU10 compares the image data DB1*n* to DB10*n* of the n-th line with the image data DB1*n*−1 to DB10*n*−1 of the (n−1)-th line for each block, and outputs determination flags frg1 to frg10 which become "0" when they match and which become "1" when they do not match. As a result, it is possible to specify the block in which there is a change in the image data D between horizontal lines which are adjacent in a data time-series manner.

Next, the determination memory 350 stores the determination flags frg1 to frg10, and reads them in the sequence of frg1, frg2, . . . , frg10 at a predetermined timing in order to generate a determination signal DS.

Next, the control circuit 360 generates an X transfer start pulse DX of a block period, and generates an X clock signal XCK synchronized with the X transfer start pulse DX and time-division data D' in accordance with the determination signal DS.

FIG. 3 is a timing chart of various signals in a control circuit in a case where it is assumed that there is a change in all the blocks between adjacent horizontal lines. As shown in this figure, the number of times the X transfer start pulse DX becomes active ("1") in one horizontal scanning period 1H matches the number of blocks (10 in this example).

The time-division data D' includes selected data SD and image data D. The selected data SD is 10 bits long, and each bit indicates to which block the image data D which follows the selected data SD concerned corresponds. Specifically, if the LSB of the selected data SD is "1", the image data D is DB1 which corresponds to the first block B1, and if the MSB of the selected data SD is "1 ", the image data D is DB10 which corresponds to the tenth block B10. The reason the selected data SD and the image data D are generated and output as the time-division data D' rather than being individually generated and output in the control circuit 360 is for the purpose of simplifying the wiring up to a data line driving circuit 200 (to be described later) and the internal wiring thereof.

Next, FIG. 4 is a timing chart of various signals of a control circuit in a case where there is a change only in the second block in the image data between adjacent horizontal lines. As shown in this figure, the X clock signal XCK has a clock pulse (active) only in a period Tb2 corresponding to the second block B2 and does not have a clock pulse (non-active) in the other periods. In other words, the control device 300 compares the image data D between horizontal lines which are adjacent in a data time-series manner, and stops the generation of the X clock signal XCK for the block in which the data values match.

In the image data D which forms the time-division data D', only D65, D66, . . . , D128 corresponding to the second block B2 are active, and the previous value is maintained for the blocks other than the second block B2.

For example, if it is assumed that the image data D is formed in a 5-bit parallel form and the output wiring of the time-division data D' is 5 bits long, the 10-bit selected data SD is represented by 2 words. In this case, the first word of the selected data SD of the first block B1 is "00000", and the second word thereof is "00001".

In this example, since the first block B1 is a block in which there is no change, in a period Tb1, the data value of the image data D is "00001". That is, the data value is the same data value as that of the second word of the selected data SD. Also, in a period Tb3, the data value of the image data D matches the second word "00011" of the selected data SD.

In other words, the control device 300 compares the image data D between horizontal lines which are adjacent in a data time-series manner, and stops the output of the image data D for the block in which the data values match and maintains the previous data value.

<1-5. Data Line Driving Circuit>

Next, the data line driving circuit 200 is described. FIG. 5 is a block diagram showing the structure of the main part of the data line driving circuit. As shown in FIG. 5, the data line driving circuit 200 includes a shift register section 210, a sampling section 220, a first latch section 230, a second latch section 240, and a DA conversion section 250.

First, the shift register section 210 shifts the X transfer start pulse DX in sequence in accordance with the X clock signal XCK in order to generate sampling pulses SP1, SP2, . . . , SP640 as appropriate. Each of the sampling pulses SP1, SP2, . . . , SP640 is a signal which becomes active in sequence exclusively for each period of a half cycle of the X clock signal XCK.

Next, the sampling section 220 includes 640 switching circuits SW1 to SW640 (see FIG. 6). On/off of each of the switching circuits SW1, SW2, . . . , SW640 is controlled by the sampling pulses SP1, SP2, . . . , SP640. This sampling section 220 samples the image data D when the sampling pulses SP1, SP2, . . . , SP640 are active (H level) and supplies the data to the first latch section 230. Since the image data D in this embodiment is in a 5-bit parallel form in the manner described above, each of the switching circuits SW1 to SW640 is formed of 5 switching devices.

Next, the first latch section 230 is formed of 10 latch units (not shown) and latches the image data D supplied via the sampling section 220. As a result, the image data D is converted into point sequence image data DA1 to DA640. Also, the second latch section 240 is constructed so as to latch the point sequence image data DA1 to DA640 by using a latch pulse LAT. Here, the latch pulse LAT is a signal which becomes active every horizontal scanning period. Therefore, the point sequence image data DA1 to DA640 is converted into line sequence image data Db1 to Db640 by this second latch section 240.

Next, the DA conversion section 250 has 640 DA conversion sections (not shown), converts the line sequence image data Db1 to Db640 from digital signals into analog signals, and outputs these signals as data line signals X1 to X640, to 640 data lines 6*a*, respectively. The DA converter may take any form. For example, a decoder type, a resistance-division type, a capacitance-division type, as well as a type in which charging and discharging are repeated by the number of times corresponding to the gray scale values of the line sequence image data Db1 to Db640 between the internal capacitance of the DA converter and the parasitic capacitance of the data lines 6*a*, may be used.

Next, the detailed structure of the shift register section 210 is described. FIG. 6 is a block diagram showing the construction of the shift register section and peripheral circuits thereof. As shown in this figure, the shift register section 210 includes 10 shift registers SR1 to SR10 and 10 DX selection circuits SL1 to SL10, a clock signal supply line CKL, a switching circuit 212, and a latch circuit 213. This shift register section 210 has features in that the shift register is divided into blocks and the shift registers SR1 to SR10 corresponding to the blocks B1 to B10, respectively, are provided.

In such a circuit construction, the latch circuit 213 takes in the selected data SD within the time-division data D' via the switching circuit 212, latches this data, and supplies, as the selection control signals SS1 to SS10, each bit of the latched selected data SD to the DX selection circuits SL1 to SL10.

Each of the DX selection circuits SL1 to SL10 supplies the X transfer start pulse DX to the shift registers SR1 to SR10, respectively, when the selection control signals SS1 to SS10 are "1", and does not supply the X transfer start pulse DX to each of the shift registers SR1 to SR10 when the selection control signals SS1 to SS10 are "0".

Consequently, each of the shift registers SR1 to SR10 becomes operable only in the selected period of each of the corresponding blocks B1 to B10. In addition, in the manner described above, the X clock signal XCK becomes active only in the selected period of the block in which there is a change between horizontal lines which are adjacent in a data time-series manner, and becomes non-active in the selected period of the other blocks.

As a result, shift registers among the shift registers SR1 to SR10, which transfer the X transfer start pulse DX in practice and generate the sampling pulses SP1, SP2, . . . , SP640, are limited to those corresponding to the block in which there is a change between horizontal lines which are adjacent in a data time-series manner.

As described above, the reason the shift register section 210 is divided into blocks is that the X clock signal XCK is supplied only for the block in which there is a change in the adjacent horizontal lines.

In a case where the shift registers SR1 to SR10, which are divided into blocks as in this example, are used, or also in a case where one shift register is used as in the conventional case, the X clock signal XCK must be supplied to the latch circuits which form the shift register and, therefore, the wiring length of the X clock signal supply line CKL is long. For this reason, the capacitance of the wiring itself and the input capacitance of each latch circuit occurs as parasitic capacitance in the X clock signal supply line CKL. Therefore, when viewed from the control device 300 which supplies the X clock signal XCK to the X clock signal supply line CKL, the X clock signal supply line CKL is a capacitive load. On the other hand, the frequency of the X clock signal XCK is ½ of the dot clock frequency, which is very high. For this reason, if the control device 300 always drives the X clock signal supply line CKL, which is a capacitive load, a lot of electric power is consumed.

However, according to this embodiment, the shift register section 210 is divided into blocks, so that the image data D is sampled only for the block in which there is a change between horizontal lines which are adjacent in a data time-series manner. Therefore, the power consumption is reduced by supplying the X clock signal XCK so that each of the shift registers SR1 to SR10 is operated only in the selected period of the block concerned and by stopping the supply of the X clock signal XCK in the other periods. In other words, the shift registers SR1 to SR10 are adopted which are divided into blocks so that even if the supply of the X clock signal XCK is stopped as necessary, necessary sampling pulses SP1, SP2, . . . , SP640 can be generated.

Furthermore, as a result of dividing the shift register into blocks, the sampling pulse SP is generated only for the block in which there is a change between horizontal lines which are adjacent in a data time-series manner. Therefore, the electric power consumed by the shift registers SR1 to SR10 can also be reduced.

For example, if it is assumed that the image to be displayed in the image display area A is solid-white, since the image data D of all the lines, excluding the first line, has the same data value as that of the image data D which is previous by one horizontal scanning period, it suffices to supply the X clock signal XCK in only the first line, and it suffices to generate the sampling pulses SP1, SP2, . . . , SP640 similarly in only the first line. For this reason, in the field period concerned, the electric power required to supply the X clock signal XCK and the electric power required to generate the sampling pulses SP1, SP2, . . . , SP640 can be reduced to approximately 1/300.

Next, the sampling section 220 includes an image data supply line DL, and switching circuits SW1 to SW640, and performs sampling only when each of the sampling pulses SP1 to SP640 becomes active.

Since the image data supply line DL intersects the 640 wirings for supplying the sampling pulses SP1 to SP640, capacitances thereof occur in the image data supply line DL, and furthermore, the input capacitances of the switching circuits SW1 to SW640 of the switching circuits SW1 to SW640 occur therein. Therefore, when viewed from the control device 300 which supplies the time-division data D' to the image data supply line DL, the image data supply line DL is a capacitive load. On the other hand, the frequency of the time-division data D' is a dot clock frequency, which is very high. For this reason, if the control device 300 always drives the image data supply line DL, which is a capacitive load, a lot of electric power is consumed.

However, according to this embodiment, the image data D is sampled only for the block in which there is a change between horizontal lines which are adjacent in a data time-series manner. Therefore, it is sufficient to supply the image data D within the time-division data D' only in the selected period of the block concerned. Also, if the logic level is changed, electric power is consumed therein.

Therefore, the control device 300 reduces the power consumption by stopping the output of the image data D in order to maintain the previous data value for the block in which the image data values match between horizontal lines which are adjacent in a data time-series manner. For example, if it is assumed that the image to be displayed in the image display area A is solid-white, the image data D of all the lines, excluding the first line, has the same data value as that of the image data D which is previous by one horizontal scanning period. Therefore, it is sufficient to supply the image data D only in the first line. For this reason, electric power required to supply the image data D in the field period concerned can be reduced to approximately 1/300.

<1-6. Operation of the First Embodiment>

Next, the operation of the liquid-crystal device according to the first embodiment is described. Here, as shown in FIG. 7, a case in which one black line is displayed in the center of the screen in a white background is taken as an example. It is assumed that the black line is displayed in the 150-th line.

FIG. 8 is a timing chart illustrating the operation of the liquid-crystal device. Initially, the scanning line driving circuit 100 shifts the Y transfer start pulses DY in sequence in accordance with the Y clock signal YCK in order to generate scanning line signals Y1, Y2, . . . , Y300 shown in the figure, and supplies these signals to the scanning lines 3*a,* respectively.

On the other hand, in the data line driving circuit 200, the sampling pulses SP1 to SP640 are generated in accordance with the X clock signal XCK supplied from the control device 300, and the image data D which forms the time-division data D' is sampled using the sampling pulses. In this example, since a black line is displayed only in the 150-th line, between the 149-th line and the 150-th line, the values of the image data D do not match in all the blocks B1 to B10. The same also applies to the 150-th line and the 151-th line. In addition, since, for the first line, there is no previous line for the object of comparison, also in the line concerned, the values of the image data D do not match in all the blocks B1 to B10. In the figure, a suffix is given to show the X clock signal XCK corresponding to the n-th line and the time-division data D'. For example, XCKn denotes an X clock signal XCK of the n-th line, and D'n denotes image data of the n-th line.

Initially, in the first line, as shown in the figure, an X clock signal XCK1 and the time-division data D'1 are supplied to the clock signal supply line CKL and the image data supply line DL.

Next, in all the blocks B1 to B10, since the value of the image data D of the second line matches that of the first line, the logic level of the X clock signal XCK becomes "0". On the other hand, the image data D which forms time-division data D'2 becomes non-active, and the previous data value is maintained. For this reason, in the second line, no electric power is required to drive the X clock signal supply line CKL, and an extremely small amount of electric power is required to drive the image data supply line DL. In addition, also from the third line to the 149-th line, since the data values of the image data D are the same, an extremely small amount of electric power is required to supply the X clock signal XCK and the time-division data D' as in the second line.

Next, in the 150-th line, since the gray scale of the image to be displayed is switched from white to black, between the 149-th line and the 15-th line, the values of the image data D do not match in all the blocks B1 to B10. The same also applies to the 150-th line and the 151-th line. For this reason, X clock signals XCK150 and XCK151 of the 150-th line and the 151-th line become active, and time-division data D'150 and D'151 also become active in a similar manner. Therefore, in these lines, electric power is consumed to supply the X clock signal XCK and the time-division data D'.

Next, from the 153-th line to the 300-th line, an extremely small amount of electric power is required to supply the X clock signal XCK and the time-division data D' in a manner similar to that from the second line to the 149-th line.

Therefore, lines which consume electric power are only the first line, the 150-th line, and the 151-th line, and in the other lines, an extremely small amount of electric power is required to supply the X clock signal XCK and the time-division data D'. As a result, electric power required to supply the X clock signal XCK and the time-division data D' can be reduced to approximately 1/100.

In the manner described above, in this embodiment, since sampling pulses SP are generated in block units by dividing the shift register SR which is the main portion of the shift register section 210 into blocks, sampling is performed only for the block in which there is a change in the data values of the image data D between adjacent lines, and the sampling operation is stopped for the other blocks. As a result, it is possible to supply the X clock signal XCK and the image data D in block units, and power consumption caused by these supplies can be greatly reduced.

<2. Second Embodiment>

Next, a liquid-crystal device according to a second embodiment of the present invention is described. In the above-described first embodiment, an operation for rewriting the image data D is performed in block units. In comparison, in accordance with the liquid-crystal device of the second embodiment, when there is a change in the data values in a portion of one block, rewriting is performed by collecting a certain amount of mismatch portions, and rewriting is not performed for the other portions.

The liquid-crystal device of the second embodiment has components which are the same as those of the liquid-crystal device of the first embodiment shown in FIG. 1, except that a control device 300' which generates and outputs an enable signal EN is used instead of the control device 300, and a sampling section 220' having an enable input is used instead of the sampling section 220, which is a constituent of the data line driving circuit 200. Differences will now be described below.

<2-1. Control Device>

The control device 300' will be described first. FIG. 9 is a block diagram of the control device used in the second embodiment. The control device 300' is constructed similarly to the control device 300 of the first embodiment shown in FIG. 2, except for the following points.

A first difference is that a comparison circuit 340' that makes a comparison in dot units is used instead of the comparison circuit 340 that makes a comparison in block units. The comparison circuit 340' compares the image data Dn of the n-th line with the image data Dn−1 of the (n−1)-th line in dot units and creates determination flags FRG1 to FRG640.

A second difference is that a determination memory 350' that stores the determination flags in dot units is used instead of the determination memory 350 that stores determination flags in block units. The determination memory 350' has a storage capacity of 640 bits and stores the determination flags FRG1 to FRG640.

A third difference is that a control circuit 360' having a delay counter therein is used instead of the control circuit 360. The control circuit 360' can be formed of a CPU (Central Processing Unit), etc., and generates an X clock signal XCK, time-division data D', and an enable signal EN in accordance with a determination signal DS read from the determination memory 350'.

First, the X clock signal XCK is generated in accordance with the determination signal DS. In this case, the control circuit 360 determines the logic level of the determination signal DS in block units, and generates the X clock signal XCK on the basis of the determination result. Specifically, if the logic level of the determination signal DS is "1" even for one bit in each block, for the block concerned, an X clock signal XCK having a clock pulse is generated, and the X clock signal XCK is set to be active. On the other hand, if the logic level of the determination signal DS is "0" for all the dots in each block, supply of the X clock signal XCK is stopped for the block concerned. That is, the X clock signal XCK is generated as in the first embodiment.

Next, the enable signal EN is a control signal that stops rewriting of image data for a predetermined dot in which the image data values match, even in a case where the image data values do not match between adjacent lines for a portion of a particular block. In the sampling section 220' (to be described later), sampling of the image data D is performed when the enable signal EN is active (in this example, logic level "1"), whereas sampling of the image data D is stopped when the enable signal EN is non-active.

In the manner described above, by controlling sampling of the image data D in dot units, it is possible to reduce the number of times the image data D is supplied to the image data supply line DL, making it possible to reduce power consumption even more.

However, as shown in FIG. 11 (to be described later), in order to control each of the switching circuits SW1 to SW640 which form a sampling section 220' using the enable signal EN, a dedicated enable signal supply line ENL is necessary. Parasitic capacitance occurs in this enable signal supply line ENL in a manner similar to the image data supply line DL and the X clock signal supply line XCK. For this reason, the control device 300' consumes a lot of electric power in order to drive the enable signal supply line ENL.

Therefore, in order to reduce power consumption of the control device 300' using the enable signal EN, electric power which can be saved by causing the image data D to be non-active needs to be greater than the electric power consumed by supplying the enable signal EN.

For example, in a case where a particular line is a black line and the next line is a line in which black and white are reversed for each dot, if the enable signal EN is inverted in dot units in the next line, a lot of electric power is consumed to supply the enable signal EN.

Accordingly, in this embodiment, it is determined whether or not a predetermined number of dots, in which the image data values match between horizontal lines which are adjacent in a data time-series manner, continue. When a predetermined number of dots continues, the enable signal EN is set to be non-active. This is described below specifically.

FIG. 10 is a flowchart showing the operation of the control circuit 360' for the generation of an enable signal and image data. Initially, the control circuit 360' sets the count value of the internal delay counter to an initial value (step S1). The delay counter is used to count the number of dots in which the image data D does not match between adjacent lines, and is formed of a down-counter. In this example, the initial value is set to "3".

Next, the control circuit 360' reads the determination signal DS from the determination memory 350' (step S2), and determines whether or not the logic level thereof is "1" (step S3).

If the logic level of the determination signal DS is "1", that is, if the image data values between adjacent lines match, the process proceeds to step S4, whereby it is determined whether or not the counting of the delay counter has been terminated.

When the counting has been terminated, the determination result of step S4 is "YES", and the process proceeds to step S5, whereby an enable signal EN for causing the logic level to be "0" is output and the image data D of the time-division data D' is set to be non-active. That is, the immediately previous data value is maintained, and the output of the image data D is stopped (step S6).

On the other hand, if the logic level of the determination signal DS is "0", that is, if the image data values between adjacent lines do not match, the determination result of step S3 is "NO". The process then proceeds to step S7, whereby the count value of the delay counter is reset to an initial value, after which the process proceeds to step S4.

When it is determined in step S4 that the counting of the delay counter has not been terminated, the process proceeds to step S8, whereby the count value of the delay counter is decremented by "1", and the enable signal EN and the image data D are set to be active (steps S9 and S10).

Thereafter, it is determined whether or not the image data D for one line has been processed, and when the image data has been processed, the process returns to step S1, whereby the processing of the next line is started (step S11). When, on the other hand, the image data has not been processed, the process returns to step S3, whereby steps S3 to S11 are repeated until the processing of the line concerned is terminated.

In the above processing, it is assumed that, for example, the image data values do not match for a particular dot, the count value of the delay counter is "2", a mismatch occurs for the next dot, and the count value of the delay counter becomes "1". If the image data values match for the subsequent dot, the count value thereof will be reset to "3" which is an initial value. That is, unless three dots in which the image data values match continue, the enable signal EN does not become non-active.

FIG. 11 is a timing chart of a determination signal, an X clock signal, an enable signal, and time-division data. In this example, it is assumed that the image data value of a particular horizontal line does not match the image data value of the previous horizontal line in the first dot, the third dot, the fifth dot, the seventh dot, and the ninth dot, and matches in the other dots, and that the initial value of the delay counter is "3".

In this case, in the determination signal DS, inversion in dot units is repeated up to the ninth dot, and "1" is maintained from the tenth dot to the 64-th dot. In the first block B1, since there is a dot in which the image data values do not match between adjacent horizontal lines, the X clock signal XCK becomes active, as shown in the figure. On the other hand, the enable signal EN becomes non-active only after there are three continuous dots in which a match occurs. For this reason, the time when the enable signal EN becomes "0" is time Z and later, as shown in the figure. In addition, at time Z and later, since the value of the image data D which forms the time-division data D' matches the immediately previous data value, D11 continues.

As a result, it is possible to prevent inadvertent inversion of the enable signal EN, and even if electric power is consumed by the driving of the enable signal supply line ENL, it is possible to reduce the power consumption caused by the driving of the image data supply line DL. This makes it possible to reduce the power consumption even more when viewed from the entire apparatus.

<2-2. Sampling Section>

Next, the sampling section 220' according to this embodiment is described. FIG. 12 is a block diagram of a sampling section and peripheral circuits thereof for use in the second embodiment. As shown in this figure, the sampling section 220' is constructed similarly to the sampling section 220 of the first embodiment shown in FIG. 6, except that an enable signal supply line ENL for supplying an enable signal EN is provided and the sampling pulses SP1, SP2, . . . , SP640 are supplied to the switching circuits SW1 to SW640, respectively, via AND circuits AND1 to AND640 (gate circuits).

In this sampling section 220', only when the logic level of the enable signal EN is "1", the sampling pulses SP1, SP2, . . . , SP640 are supplied to the switching circuits SW1 to SW640, respectively. Therefore, by controlling the logic level of the enable signal EN, it is possible to control sampling in dot units.

In the manner described above, the enable signal EN becomes non-active for a predetermined dot in which the image data values match, even when the image data values do not match between horizontal lines which are adjacent in a data time-series manner in a portion of a particular block, and therefore, it is not necessary to drive the image data supply line DL for the dot concerned. For this reason, it becomes possible to control whether or not the image data D should be supplied to the image data supply line DL in dot units, making it possible to reduce the electric power required for driving.

<3. Example of Structure of Liquid-crystal Panel>

Next, the overall structure of the liquid-crystal panel AA described in the above-described first embodiment and second embodiment will be described with reference to FIGS. 13 and 14. FIG. 13 is a perspective view showing the structure of the liquid-crystal panel AA, and FIG. 14 is a sectional view along the plane Z–Z' in FIG. 13.

As shown in these figures, the liquid-crystal panel AA has a structure in which a device substrate 101, such as glass or a semiconductor, on which pixel electrodes 9*a*, etc., are formed, and a transparent opposing substrate 102, such as glass, on which a common electrode 108, etc., is formed, are laminated together in such a manner that their electrode formed sides oppose each other at a fixed spacing held by a sealing material 104 in which a spacer 103 is mixed, and a liquid crystal 105, as an electro-optical material, is disposed in this spacing. The sealing material 104 is formed around the periphery of the opposing substrate 102, and a portion thereof is opened so as to cause the liquid crystal 105 to be sealed. For this reason, after the liquid crystal 105 is sealed, that opened portion is filled in by a sealing material 106.

Here, the structure is formed in the following manner. On one side of the outside of the sealing material 104, which is an opposing side of the device substrate 101, the above-described data line driving circuit 200 is formed, so that the data lines 6*a* extending in the Y direction are driven. Furthermore, a plurality of connection electrodes 107 are formed in this one side, so that various signals from the control device 300 are input.

Furthermore, on two sides adjacent the one side, two scanning line driving circuits 100 are formed, so that the scanning lines 3*a* extending in the X direction are driven from both sides. If the delay of the scanning signal supplied to a scanning line 112 does not pose a problem, one scanning line driving circuit 100 may be formed on only one side.

On the other hand, the common electrode 108 of the opposing substrate 102 makes electrical conduction with the device substrate 101 by a conducting material, provided in at least one portion of the four corners in the laminated portion with the device substrate 101. In addition, the following are provided on the opposing substrate 102 according to the uses of the liquid-crystal panel AA, for example: first, color filters arranged in a stripe shape, in a mosaic shape, in a triangular shape, etc.; second, a black matrix, such as a resin black, in which a metallic material, such as chromium and nickel, carbon, or titanium, is dispersed in a photoresist; and third, a backlight that illuminates the liquid-crystal panel 100. In particular, in the case of uses for color light modulation, color filters are not formed, and a black matrix is provided on the opposing substrate 102.

In addition, on the opposing side of the device substrate 101 and the opposing substrate 102, oriented films, which are each subjected to a rubbing process in a predetermined direction, are provided, and polarizers (not shown), according to an orientation direction, are provided in each of the rear portions thereof. However, if a polymer-dispersed-type liquid crystal, which is dispersed as very fine particles in a polymer, is used as the liquid crystal 105, since the above-described oriented films, polarizers, etc., are not necessary, light use efficiency is improved, which is advantageous in higher luminance and lower power consumption.

Instead of forming portions or the entirety of the peripheral circuits of the scanning line driving circuit 100 and the data line driving circuit 200 on the device substrate 101, for example, driving IC chips mounted on a film using a TAB (Tape Automated Bonding) technique may be electrically and mechanically connected via an anisotropic conductive film provided at a predetermined position of the device substrate 101. Alternatively, driving IC chips may be electrically and mechanically connected via an anisotropic conductive film provided at a predetermined position of the device substrate 101 by using a COG (Chip On Glass) technique.

<4. Application Examples of Liquid-crystal Device>

Next, a description is given of a case in which the liquid-crystal device described in the first embodiment and the second embodiment is applied to various electronic apparatuses.

<4.1: Projector>

First, a projector in which this liquid-crystal device is used as a light valve is described. FIG. 15 is a plan view showing an exemplary structure of the projector.

As shown in this figure, inside a projector 1100, a lamp unit 1102 formed of a white light source, such as a halogen lamp, is provided. The projected light emitted from this lamp unit 1102 is separated into three primary colors of RGB by four mirrors 1106 and two dichroic mirrors 1108, disposed inside a light guide 1104, and is made to enter liquid-crystal panels 1110R, 1110B, and 1110G as light valves corresponding to each of the primary colors.

The liquid-crystal panels 1110R, 1110B, and 1110G are formed similarly to the above-described liquid-crystal panel AA, and are driven in accordance with primary-color image information (image data, image signals) of R, G, and B supplied from an image signal processing circuit (not shown). The light modulated by these liquid-crystal panels is made to enter a dichroic prism 1112 from three directions. In this dichroic prism 1112, light of R and B is refracted by 90 degrees, and light of G travels straight. Therefore, as a result of images of each color being combined, a color image is projected on a screen, etc., via a projection lens 1114.

Concerning the display image by each of the liquid-crystal panels 1110R, 1110B, and 1110G, it is necessary for the display image by the liquid crystal panel 1110G to be bilaterally inverted with respect to the display image by the liquid-crystal panels 1110R and 1110B.

Since light corresponding to each of the primary colors of R, G, and B enters the liquid-crystal panels 1110R, 1110B, and 1110G by a dichroic mirror 1108, it is not necessary to provide color filters therein.

<4-2. Mobile Computer>

Next, a description is given of an example in which the above-described liquid-crystal device is applied to a mobile personal computer. FIG. 16 is a perspective view showing the structure of this personal computer. In the figure, a computer 1200 includes a main unit section 1204 having a keyboard 1202, and a liquid-crystal display unit 1206. This liquid-crystal display unit 1206 is formed by adding a backlight to the rear side of the liquid-crystal panel described above.

<4-3. Portable Phone>

Furthermore, a description is given of an example in which the above-described liquid-crystal device is applied to a portable phone. FIG. 17 is a perspective view showing the structure of the portable phone. In the figure, a portable phone 1300 includes a plurality of operation buttons 1302, and a reflection-type liquid-crystal panel. In this reflection-type liquid-crystal panel, a front light is provided on the front thereof as necessary.

In addition to the electronic apparatuses described with reference to FIGS. 14 to 17, examples thereof include liquid-crystal televisions, view-finder-type and monitor-direct-view-type video tape recorders, car navigation apparatuses, pagers, electronic notebooks, electronic calculators, word processors, work stations, television phones, POS terminals, and apparatuses having a touch panel. It is a matter of course that the liquid-crystal device can be applied to these various electronic apparatuses.

<5. Modifications>

(1) In each of the above-described embodiments and application examples, the entirety or portions of the control devices 300 and 300' may be contained in the liquid-crystal panel AA. In this case, TFTs may be used as active devices which form the control devices 300 and 300', and the control devices 300 and 300' may be formed on the device substrate 101 by the same semiconductor process as that of the TFTs used for the scanning line driving circuit 100 and the data line driving circuit 200. In particular, in a case where portions of the control devices 300 and 300' are formed on the device substrate 101, it is preferable that portions, excluding the control circuits 360 and 360', the address generator 370, and the frame memory 310, be taken into the liquid-crystal panel AA.

(2) In each of the above-described embodiments, although the control devices 300 and 300' and the data line driving circuit 200 were described as being individual devices, it is a matter of course that these may be combined so as to be recognized as a data line driving device.

(3) In each of the above-described embodiments, although the DA conversion section 250 was described as being always ready to operate, a data line signal may be supplied to each of the data lines 6*a* only for the block in which there is a change between horizontal lines which are adjacent in a data time-series manner. Also, for the portion which does not require the DA conversion section 250 to operate, power supply may be cut in block units.

As has thus been described, according to the present invention, since supply of a clock signal and image data is stopped for the block, in which the image data values match between horizontal lines which are adjacent in a data time-series manner, it is possible to greatly reduce power consumption of the electro-optical device.

What is claimed is:

1. A data line driving circuit of an electro-optical panel which has a plurality of scanning lines, a plurality of data lines, and switching devices and pixel electrodes arranged in such a manner as to correspond to intersections of said scanning lines and said data lines, and which is divided into blocks in units of a predetermined number of data lines, said data line driving circuit comprising:

a shift register section having a clock signal supply line that supplies a clock signal only for a block in which image data values do not match between horizontal lines which are adjacent in a data time-series manner, a plurality of registers that sequentially shift a transfer start pulse in accordance with said clock signal in order to generate each sampling signal, said plurality of registers being provided in such a manner as to correspond to each of said blocks, and a selection circuit that selectively supplies said transfer start pulse to each of said registers;

an image data conversion section that samples image data in accordance with each of said sampling signals and converts the data obtained by performing sampling into line sequence image data after the data is latched; and a DA conversion section that outputs each data line signal obtained by performing DA conversion on said line sequence image data to each of said data lines.

2. The data line driving circuit according to claim 1, said sampling section performing sampling in accordance with each of said sampling signals only when an enable signal supplied from the outside becomes active.

3. A method of controlling the data line driving circuit as set forth in claim 1, comprising the steps of:

comparing image data between horizontal lines which are adjacent in a data time-series manner; and stopping the supply of said clock signal for a block in which the data values match.

4. A method of controlling the data line driving circuit as set forth in claim 1, comprising the steps of:

comparing image data between horizontal lines which are adjacent in a data time-series manner; and stopping the supply of said image data for a block in which the data values match.

5. An electro-optical device, comprising:

an electro-optical panel which has a plurality of scanning lines, a plurality of data lines, and switching devices and pixel electrodes arranged in such a manner as to correspond to intersection of said scanning lines and said data lines, and which is divided into blocks in units of a predetermined number of data lines;

a data line driving circuit that generates each data line signal to be supplied to each of said data lines;

a scanning line driving circuit that generates each scanning line signal to be supplied to each of said scanning lines; and a control circuit that controls said data line driving circuit on the basis of image data, wherein said control circuit includes:

a determination section that compares said image data between horizontal lines, which are adjacent in a data time-series manner, in order to determine whether or not the data values match between the horizontal lines for each of said blocks and generates a determination signal which indicates the determination result for each of said blocks; and a clock signal generation section that generates, in accordance with said determination signal, a clock signal which becomes active only for the block in which there is a change in the data values between the horizontal lines which are adjacent in a data time-series manner, and wherein said data line driving circuit includes:

a shift register section having a plurality of registers which sequentially shift the transfer start pulse of a block period in accordance with said clock signal in order to generate each sampling signal, said plurality of registers being provided in such a manner as to correspond to each of said blocks, a clock signal supply line that supplies said clock signal to each of said registers, and a selection circuit that supplies said transfer start pulse to each of said registers in accordance with a selection signal indicating to which block the image data corresponds;

an image data conversion section that samples image data in accordance with each of said sampling signals and converts the data obtained by performing sampling into line sequence image data; and a DA conversion section that outputs each data line signal obtained by performing DA conversion on said line sequence image data to each of said data lines.

6. The electro-optical device according to claim 5, said determination section including:

a first line memory that stores image data;

a second line memory that stores the image data which is previous by one horizontal scanning period;

a comparison circuit that compares first image data read from said first line memory with second image data read from said second line memory in order to determine whether or not the data values match between horizontal lines for each of said blocks; and a determination memory that stores the determination result of said comparison circuit for each block, wherein said determination signal is generated by sequentially reading the determination result from said determination memory.

7. The electro-optical device according to claim 5, said control circuit including an image data creation section that creates image data which becomes active only for the block in which there is a change in the data value between horizontal lines in accordance with said determination signal, and supplies the image data which is created via an image data supply line to said sampling section.

8. The electro-optical device according to claim 7, said image data creation section creating a time-division signal in which said selection signal is interposed before said image data divided for each block and supplies this signal to said sampling section via said image data supply line, said shift register section including a separation circuit that separates said selection signal from said time-division signal, and said sampling section samples the portion of said image data within said time-division signal.

9. The electro-optical device according to claim 8, said time-division signal creation section causing the last logic level of said selection signal to continue for the block in which said image data becomes non-active.

10. An electro-optical device, comprising:

an electro-optical panel having a plurality of scanning lines, a plurality of data lines, and switching devices and pixel electrodes arranged in such a manner as to correspond to intersections of said scanning lines and said data lines, said electro-optical panel being divided into each of blocks in units of a predetermined number of data lines;

a data line driving circuit that generates each data line signal to be supplied to each of said data lines;

a scanning line driving circuit that generates each scanning line signal to be supplied to each of said scanning lines; and a control circuit that controls said data line driving circuit in accordance with image data, wherein said control circuit includes:

a determination section that compares said image data between horizontal lines which are adjacent in a data time-series manner in order to determine whether or not the data values match between the horizontal lines for each dot;

an enable signal generation section that generates, based on the determination result of said determination section, an enable signal which becomes non-active for a predetermined dot in which the data values match between the horizontal lines; and an image data creation section that outputs the image data to an image data supply line when said enable signal becomes active, and wherein said data line driving circuit includes:

sampling sections, each sampling section sampling said image data in accordance with each sampling signal only when said enable signal becomes active;

an image data conversion section that converts the data obtained by performing sampling by said sampling section into line sequence image data; and a DA conversion section that outputs each data line signal obtained by performing DA conversion on said line sequence image data to each of said data lines, said control circuit including a clock signal generation section that generates, based on the determination result of said determination section, a clock signal which becomes active only for a block in which there is a change in the data values between horizontal lines which are adjacent in a data time-series manner.

11. The electro-optical device according to claim 10, said determination section including:

a first line memory that stores image data;

a second line memory that stores image data which is previous by one horizontal scanning period;

a comparison circuit that compares first image data read from said first line memory with second image data read from said second line memory for each dot; and a determination memory that stores the determination result of said comparison circuit for each block.

12. The electro-optical device according to claim 10, said enable signal generation section causing, based on the determination result of said determination section, said enable signal to become non-active when a predetermined number of dots in which the data values match between horizontal lines continue.

13. The electro-optical device according to claim 10, said image data creation section setting the level of the image data supply line to be constant when said enable signal becomes non-active.

14. The electro-optical device according to claim 10, said data line driving circuit including a shift register section having a plurality of registers which each sequentially shift a transfer start pulse of a block period in accordance with said clock signal in order to generate each sampling signal, and which correspond to said blocks, respectively, a clock signal supply line that supplies said clock signal to each of said registers, and a selection circuit that supplies said transfer start pulse to each of said registers in accordance with a selection signal indicating to which block the transfer start pulse corresponds.

15. An electronic apparatus that includes the electro-optical device as set forth in claim 5 to be used as a display section.

* * * * *